US007207504B2

(12) United States Patent
Willmot

(10) Patent No.: US 7,207,504 B2
(45) Date of Patent: Apr. 24, 2007

(54) GRINDER

(75) Inventor: Eric Paul Willmot, Mount Eliza (AU)

(73) Assignee: Aimbridge Pty. Ltd., Melbourne, Victoria (AU)

( * ) Notice: Subject to any disclaimer, the term of this patent is extended or adjusted under 35 U.S.C. 154(b) by 114 days.

(21) Appl. No.: 10/514,601

(22) PCT Filed: May 16, 2003

(86) PCT No.: PCT/AU03/00588

§ 371 (c)(1),
(2), (4) Date: Nov. 16, 2004

(87) PCT Pub. No.: WO03/097243

PCT Pub. Date: Nov. 27, 2003

(65) Prior Publication Data

US 2005/0224613 A1 Oct. 13, 2005

(30) Foreign Application Priority Data

May 16, 2002 (AU) ..... PS2361

(51) Int. Cl.
*B02C 19/00* (2006.01)

(52) U.S. Cl. ..... 241/5; 241/275

(58) Field of Classification Search ..... 241/5, 241/275, 284, 79.1, 80, 19
See application file for complete search history.

(56) References Cited

U.S. PATENT DOCUMENTS 2,012,694 A * 8/1935 Runyan ..... 241/38
3,162,382 A * 12/1964 Danyluke ..... 241/53
5,353,997 A 10/1994 Kasseck et al.
5,542,615 A 8/1996 Yu

FOREIGN PATENT DOCUMENTS

| | | |
|---|---|---|
| EP | 0 696 475 B1 | 11/1999 |
| WO | WO 98/16316 A1 | 4/1998 |
| WO | WO 01/45846 A1 | 6/2001 |
| WO | WO 02/07887 A1 | 1/2002 |

* cited by examiner

*Primary Examiner*—Mark Rosenbaum
(74) *Attorney, Agent, or Firm*—Senniger Powers

(57) ABSTRACT

A grinder is disclosed which has a housing (12) in which a rotatable disc (60) is mounted. The disc (60) is rotated by a motor (40)and the disc (60) has a periphery which is adjacent an inner stationary wall (102) of the housing (12 ). An air inlet (108) is arranged below the disc and the disc carries vanes (100) so that when the disc rotates, an annular air stream is created at the periphery of the disc in which a grinding zone is established between the periphery of the disc and the stationary wall (102) for grinding material into small particles. The grinding zone includes an annular flow of heavy gas $R_1$. A material inlet (20) is provided for allowing material to enter the housing (12). Large material is grounded by energy intensification after it hits the disc (60) and collides with the inner wall (40) of the housing so as to break down the material into smaller particle size, which can then move to the grinding zone at the periphery of the disc (60) to be further ground into small particles. The small particles are collected through an outlet (16) and may be supplied to separators for separating the small particles from exhaust air from the housing (12).

11 Claims, 19 Drawing Sheets

GRINDER

FIELD OF THE INVENTION

This invention relates to a grinder for reducing material to small particles which can then be used, for example, as a fuel, fertiliser, or an additive to other constituents, broken down small size particles for convenient waste disposal, providing particles for use in industry, and also for separating material. In many cases, it is necessary for the small particles to be reduced down to small particles which have a size in the range of 5 to 50 microns and in some cases, less than 5 microns.

BACKGROUND ART

Many devices exist that can reduce material to small particle sizes, but most are large, slow, heavy, and consume large amounts of energy. However, very few machines exist which can economically reduce particles down to very small fine particle sizes.

Grinding of materials to very small particles is carried out by a variety of machines. These machines employ two main processes. The first and most common, is by crushing the material between hard moving elements made from such materials as steel or silicates until the particles are of the required size. Repeated recycling may be employed to aid the process. Such machines are rolling, ball or hammer mills.

The second method is by employing high-energy impact. Machines using this principle cause high speed, hard moving elements, to collide with the particles to be ground. The particles to be ground are usually transported into and out of the impact area by gravity and by a gas, usually air. In some cases, material to be ground is carried only by gravity into the impact zone in the same way. As well as collisions with the grinding element, there are particle to particle collisions. However, these impacts make only a very small contribution because the particles are of much the same kinetic level and are moving in much the same direction. To achieve significant particle size reduction, recycling of the process must also be employed. A beater hammer mill is typical of such machines.

The crushing process is slow and usually limited in the mining and primary metallurgy industry. Impact grinding has the potential for fast throughput and great size reduction for other industrial and commercial particle grinding. The problem with present impact machines is that particle to particle impacts make only a small contribution, and hence the necessary energy level from the momentum transfer from the impacting elements must be at the highest energy necessary to break up the particles, that is the energy levels of the particles remain only as high as the initial impact.

A need therefore exists for a small, even portable machine that can achieve these results fast and economically.

SUMMARY OF THE INVENTION

An object of a first invention is to provide an impact particle grinder which can reduce gross particles down to a much smaller particle size.

A first invention may be said to reside in an impact particle grinder, comprising;

a housing having an inner wall;

a grinding disc mounted in the housing for rotation within the housing;

means for rotating the grinding disc;

an inlet for depositing material onto a first location on the rotating disc, so kinetic energy is supplied to the material from the disc to fling the material against the inner wall of the housing, and material deflected from the housing falls back onto the disc at a second location radially outwardly of the first location so that further kinetic energy is imparted to that material to provide an energy intensifying process as material continues to impact against the inner wall of the housing and fall back on a radially more outward part of the rotating disc, and wherein particle to particle collisions within the housing and collisions with the rotating disc and inner wall break down the material to produce small particles; and outlet means for discharge of the small particles from the grinder.

Thus, the impact grinder works using two principles. The first is by repeatedly injecting energy at higher and higher levels into the particles as they are reduced in size. This is a continuous energy intensifying process.

The grinder therefore processes material step by step to higher energy levels as it impacts further out towards the periphery of the disc. This results in very great size reduction. Recycling therefore is only employed by the machine to act upon particles, which have not reached the requisite energy level by the time they impact with a radially most outward part of the disc.

Depending on the size of the particle required, the particles can simply be discharged from the machine. However, if very fine particles are required, the particles can undergo further processing to reduce the particles to fines.

In the preferred embodiment of the invention, the additional grinding to produce the small particles is performed in the grinder by establishing a further grinding zone between the periphery of the spinning disc and a stationary wall of the grinder. This embodiment requires the invention to operate in a gas rather than a vacuum, with the gas usually simply being air.

While operating in a transport medium such as air, each particle will commence breakdown, as it moves to the periphery and into the grinding zone. The grinding zone is formed by a shear zone which causes comminution of the particles to form the small particles.

In the preferred embodiment of the invention, the inner wall of the housing is of inverted conical shape so that deflection of material from the inner wall tends to direct the material to the second location which is a small distance from the first location, thereby producing a significant number of impacts of the material with the disc as the material bounces between the disc and the inner wall. The result of this increased number of collisions produces a greater number of impacts which impart increased kinetic energy to the material, and therefore greater breakdown of the material due to those impacts and particle to particle collisions.

In one embodiment of the invention the grinder includes hot air inlet means for introducing hot air into the housing adjacent the disc for drying the material as the material is ground.

In one embodiment the grinder also includes inert gas introduction means for introducing inert gas to mix with the ground particles.

In one embodiment of the invention the outlet means is arranged above the disc.

In one embodiment, the outlet means comprises a plurality of outlets which are arranged at different heights above the disc so that particles of different sizes are collected in each of the outlets, the outlets being provided in a housing wall portion which is of conical shape.

The outlet means may include a recirculator for recirculating small particles from the outlet means back to the housing for reprocessing in the housing.

In one embodiment, the outlet means is connected to a cyclone particle collector.

Preferably the cyclone particle collector comprises means for creating a circular flow of air in the cyclone, inlet means connected to the outlet means for receiving particles from the housing and for conveying the particles into the cyclone for circulation in the circular air flow in the cyclone, an air outlet tube in the cyclone and a particle outlet in the cyclone, and wherein particles trapped in the circular flow of air are conveyed about the cyclone with the circular flow of air and separated from air flow so that the particles can be collected in the particle outlet and air exit the cyclone through the air outlet.

Preferably the air inlet means for creating the circular flow of air comprises a hot air inlet and a heater for heating air for supply to the hot air inlet.

In one embodiment of the invention, the disc has an outer periphery which is in close proximity to the inner wall of the housing so that when the disc is rotated by the rotating means, an annular rotating stream of air is formed between the periphery of the disc and the inner wall, so a shear zone is created between the periphery of the disc and the inner wall so that when particles enter the space between the disc and the inner wall, they are subject to the shear zone to further reduce the particles to small particles.

An air inlet means is preferably provided below the disc in the housing for allowing air to enter the housing from below the disc to cause the air annulus to spill up the inner wall of the housing so that finely ground particles trapped in the rotating stream of air are carried by the spill of air to the outlet means.

In another embodiment of the invention, the outlet means is arranged below the disc. This embodiment would be used in environments in which the grinder is operating in a vacuum or extremely low air pressure environments, and in which the air stream at the periphery of the disc is therefore not created. Thus, in this embodiment, small particles have no option but to fall under the influence of gravity in the space between the periphery of the disc and the inner wall of the container to the outlet means below the disc.

In one embodiment the disc includes a plurality of vanes for imparting momentum to the air when the disc rotates to create the annular rotating stream of air between the periphery of the disc and the wall to create the shear zone.

Preferably the vanes are angled upwardly relative to the horizontal so that the rotating stream of air is directed upwardly above the disc to facilitate the spill of air up the inner wall.

Preferably the inner wall of the housing includes a separate cylindrical wall which includes a contoured wall portion for trapping material so the material remains in the annular airflow for a long period to break down the material to small particles, before the small particles travel in the spill of air up the inner wall to the outlet.

This invention also provides a method of impact grinding a material, comprising;

supplying the material to a grinder which has a housing having an inner wall and a rotating disc mounted in the housing;

wherein the material supplied is deposited onto a first location on the rotating disc, so kinetic energy is supplied to the material from the disc to fling the material against the inner wall of the housing, and material deflected from the housing falls back onto the disc at a second location radially outwardly of the first location so that further kinetic energy is imparted to that material to provide an energy intensifying process as material continues to impact against the inner wall of the housing and fall back on a radially more outward part of the rotating disc, and wherein particle to particle collisions within the housing and collisions with the rotating disc and inner wall break down the material to produce small particles; and collecting the small particles from the grinder.

A second invention is concerned with the breakdown of material into smaller particles.

This invention provides a grinder for producing small particles from material, comprising:

a housing having a substantially inner wall;

a disc mounted in the housing and having a periphery adjacent the inner wall;

a motor for driving the disc so the disc rotates about a substantially vertical axis;

a plurality of vanes on the disc for creating an annular flow of gas between the periphery of the disc and the inner wall to create a shear zone between the inner wall and the periphery of the disc;

an inlet in the housing for receiving the particulate material, so the particulate material is able to migrate to the shear zone between the periphery of the disc and the inner wall and be broken down to small particles; and a small particle outlet for allowing outlet of the small particles from the housing.

In this invention the particulate material may be delivered to the housing from an inlet direct to a location near the periphery of the disc for substantially direct feeding into the shear zone.

Thus, in this embodiment the inlet may comprise an inlet tube extending within the housing from an upper portion of the housing to a position adjacent the periphery of the disc.

However, in another embodiment, the particulate material may be gross material which is first broken down by impact with the disc and the housing into small particle size which small particles then move to the shear zone for further breakdown into small particles. In this latter embodiment the inlet generally comprises a tube which delivers the gross particulate material to a location inwardly of the periphery of the disc.

Preferably the housing has a gas inlet below the disc and the vanes are located on a lower surface of the disc for collecting the gas and directing the gas to the periphery of the disc to provide energy intensification to the gas so that the gas at the periphery of the disc moves with high speed, and the gas adjacent the stationary inner wall is at relatively low speed.

Preferably the grinding zone comprises a first region between the wall of the housing and an intermediate location between the wall and the periphery of the disc for establishing a heavy gas, and a second region between the periphery of the disc and the intermediate location for receiving particles from the disc so those particles can move into the heavy gas and be ground into small particles.

Preferably a shear zone is created at the intermediate location between the first and second regions.

Preferably the vanes are located on the lower surface of the disc and are directed upwardly so that the vanes direct the gas to the periphery of the disc and upwardly relative to the disc so that the annular flow of gas created by each of the vanes between the disc and the inner wall, and within the confines of the disc for a short time period and then moves upwardly relative to the disc in annular fashion adjacent the inner wall of the housing.

Preferably the housing has an exhaust gas outlet arranged substantially centrally of the disc.

Preferably a standing wave is created between the exhaust gas outlet and the periphery of the disc so that particles which are broken down into small particles in the shear zone are able to move upwardly with the airflow adjacent the inner wall of the housing to the outlet, or move inwardly of the disc where they meet the standing wave and are directed down back to the upper surface of the disc and move along the upper surface of the disc back to the shear zone for further grinding, or travel with the exhaust gas to the exhaust outlet.

Preferably the outlet is connected to a first cyclone for separating gas from the small particles so the small particles can be collected at an outlet of the first cyclone.

Preferably the exhaust gas outlet is connected to a second cyclone so the gas and small particles can be separated in the second cyclone to enable the small particles to be collected at an outlet of the second cyclone.

Preferably the first cyclone has a gas exhaust outlet which is connected to the second cyclone so that any small particles which remain in the gas exhausted from the first cyclone are fed to the second cyclone for separation from the gas in the second cyclone.

Preferably the outlet from the first cyclone includes a gas lock for preventing high pressure gas from exiting the outlet and blowing small particles into the atmosphere.

Preferably the outlet from the second cyclone also includes a gas lock for preventing high pressure gas from exiting the second cyclone through the outlet.

This invention also provides a method of producing small particles from material, comprising:

supplying the material to a housing having a substantially inner wall and a rotating disc mounted in the housing and having a periphery adjacent the inner wall so that the disc creates an annular flow of gas between the periphery of the disc and the inner wall to create a shear zone between the inner wall and the periphery of the disc;

allowing the material to migrate to the shear zone between the periphery of the disc and the inner wall and be broken down to small particles; and collecting the small particles from the housing.

Preferably the method includes allowing the gas to enter the housing from below the disc and providing vanes on a lower surface of the disc for collecting the gas and directing the gas to the periphery of the disc to provide energy intensification to the gas so that the gas at the periphery of the disc moves with high speed, and the gas adjacent the stationary inner wall is at relatively low speed, and wherein the grinding zone is created by the establishment of:

(a) a heavy gas formed from a mixture of the gas and minute particles in a first region between the inner wall and an intermediate position between the disc and the inner wall;

(b) a second region for receiving larger particles to be ground into the smaller particles, between the intermediate position and the periphery of the disc;

(c) a shear zone between the first and second regions; and wherein particles in the first region pass through the shear zone, and some are comminuted into heavy gas particles and others which are not sufficiently small to behave as gas particles are either ejected back to the first region for further grinding as those particles re-enter the heavy gas through the shear zone, or move out of the grinding zone for collection from the housing.

Preferably the annular flow of gas created by each of the vanes between the disc and the inner wall is maintained within the confines of the disc and at the shear zone for a short time period and then moves upwardly relative to the disc in annular fashion adjacent the inner wall of the housing.

Preferably the method comprises extracting gas from an exhaust outlet arranged substantially centrally of the disc.

Preferably the method further comprises creating a standing wave between the exhaust outlet and the periphery of the disc so that particles which are broken down into small particles in the shear zone move upwardly with the airflow adjacent the inner wall of the housing to the outlet, or move inwardly of the disc where they meet the standing wave and are directed down back to the upper surface of the disc, and move along the upper surface of the disc back to the shear zone for further grinding, or travel with the exhaust gas to the exhaust outlet.

Preferably the method further comprises supplying the collected small particles to a first cyclone for separating gas from the small particles so the small particles can be collected at an outlet of the first cyclone.

Preferably small particles collected at the exhaust outlet are supplied to a second cyclone so the gas and small particles can be separated in the second cyclone to enable the small particles to be collected at an outlet of the second cyclone.

The invention also provides a grinder for producing small particles from material, comprising:

a housing having an inner wall;

a rotatable mechanical member in the housing having a periphery adjacent the inner wall;

a drive for driving the rotatable member for causing the rotatable member to create an annular flow of air between the periphery of the member and the inner wall, and for establishing a grinding zone between the inner periphery and the wall which comprises:

(a) a first region in which a heavy gas is established, the first region being between the inner wall and an intermediate position between the periphery of the member and the inner wall;

(b) a second region for receiving relatively large particles compared to the particles which make up the heavy gas, the second region being between the intermediate position and the periphery of the mechanical member; and (c) a shear zone between the first and second regions at the intermediate location; and wherein the relatively large particles received in the first region come into contact with the heavy gas particles across the shear zone where the relatively heavy particles are comminuted into smaller particles, some of which add to the heavy gas within the first region and the other of which form small particles of a size which do not behave as a heavy gas, and wherein the small particles, together with some of the particles which make up the heavy gas and other larger particles from the first region move out of the grinding zone with an annular flow of air from the grinding zone and travel to a first collection outlet for collection or fall back to the mechanical member and again travel to the first region for further grinding in the grinding zone.

The invention still further provides a method of grinding material, comprising:

creating a grinding zone having a first annular region in which an annular flow of heavy gas is established and a second region spaced from the first region by a shear zone;

directing the material into the grinding zone so the material passes from the second region to the first region across the shear zone into the annular flow of heavy gas and is comminuted into smaller particles by contact between heavy gas particles in the heavy gas and the material; and collecting the comminuted particles.

A third invention relates to a grinding installation for grinding material into small particles.

This invention provides a grinding installation for producing small particles from material, comprising a grinder having:

(a) a housing having a stationary inner wall;

(b) a disc mounted in the housing and having a periphery adjacent the inner wall;

(c) a motor for driving the disc so the disc rotates about a substantially vertical axis, and whereby small particles are produced by breakdown of material impacting with the disc and the inner wall and/or in a grinding zone between the periphery of the disc and the inner wall;

(d) an air inlet in the housing;

(e) an air exhaust outlet from the housing; and (f) a particle outlet from the housing;

a first separator connected to the particle outlet for separating air from the small particles and for delivering the small particles to a small particles outlet; and a second separator connected to the exhaust air outlet for separating small particles in the exhaust air from the exhaust air and delivering the small particles to a second small particles outlet.

Preferably the first separator has a first exhaust air outlet and the first exhaust air outlet is connected to the second separator.

Preferably the first separator comprises a cyclone separator.

Preferably the second separator comprises a second cyclone separator.

A fourth invention provides a grinder for producing small particles comprising:

a first region for establishing a heavy gas, a second region spaced from the first region and a shear one between the first and second regions when the grinder is in use;

a material inlet for delivery material so the material passes to the first region for grinding; and an outlet for collecting the small particles.

BRIEF DESCRIPTION OF THE DRAWINGS

Preferred embodiments of the invention will be described, by way of example, with reference to the accompanying drawings in which.

DETAILED DESCRIPTION OF THE PREFERRED EMBODIMENTS

Figure 1:
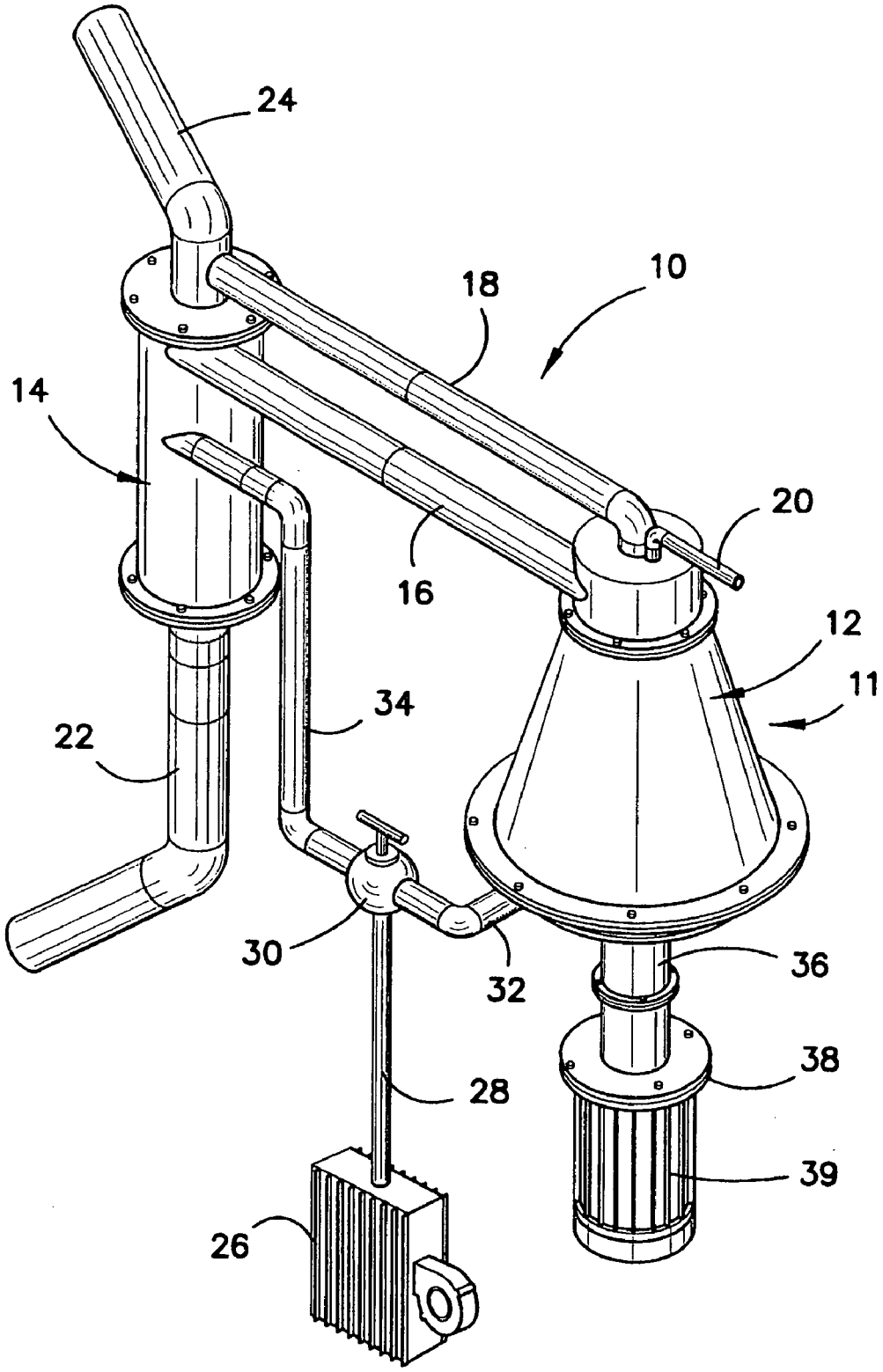
FIG. 1 is a view of a particle grinder according to one embodiment of the invention.

With reference to FIG. 1, a grinder installation 10 is shown which has a grinder 11 having grinder housing 12, and a cyclone particle separator 14. The housing 12 communicates with the cyclone 14 by a small particles outlet tube 16 from the housing 12 and an air exhaust tube 18 extending from the housing 12 to the cyclone 14. An inlet tube 20 for supply of material also communicates with the housing 12.

The cyclone 14 has a small particles outlet tube 22 and an air exhaust outlet tube 24. An air heater 26 is provided for heating air and for supplying hot air through delivery tube 28 to valve 30. A first inlet 32 is coupled between the valve 30 and the housing 12 for selectively supplying hot air to the housing 12, and a second inlet tube 34 extends between the valve 30 and the cyclone 14 for providing hot air into the cyclone 14 for creating a circular cyclonic flow of air within the cyclone 14.

The housing 12 is supported on a cylindrical casing 36 and flange 38 which connects to an electric motor 39.

Figure 2:
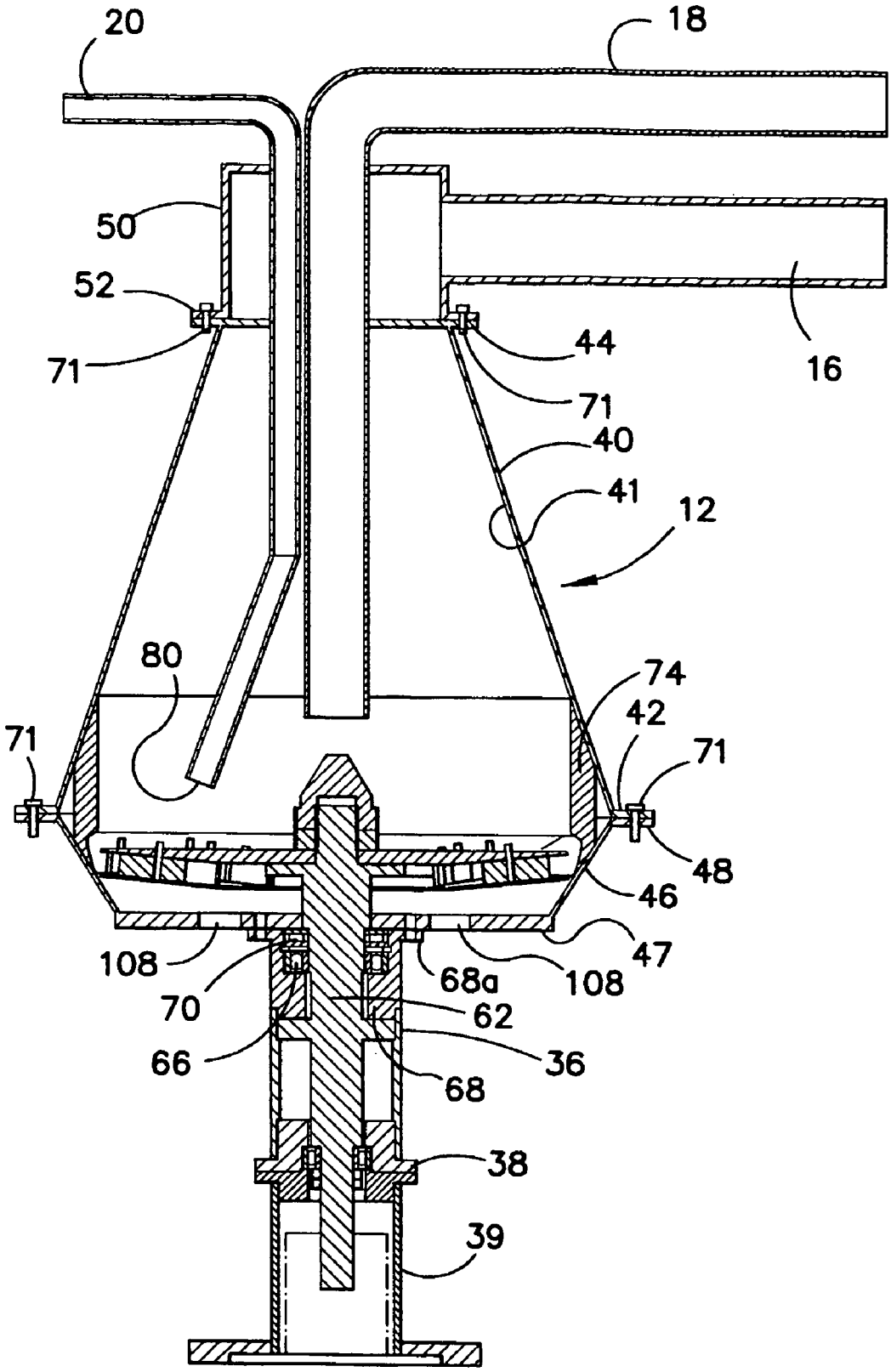
FIG. 2 is a cross-sectional view through the grinder housing of FIG. 1.

As is best shown in FIG. 2, the housing 12 is formed from a conical upper casing 40 which tapers inwardly from flange 42 at the bottom of the casing 40 to upper flange 44 at the top of the casing 40. The flange 42 is connected to a lower dish casing 46 via flange 48. The casing 40 is connected to a cap casing 50 by flange 44 on the casing 40 and flange 52 on the casing 50. The particle outlet conduit 16 communicates with the cap casing 50.

A disc 60 is mounted in the casing 46 and is supported on a shaft 62 which is arranged in bearings 66 and bushes 68 within the cylindrical casing 36. Thrust bearings 70 may also be provided if desired.

The cylindrical casing 36 is secured to the base 47 of the dish casing 46 by flange 68*a* on the cylindrical casing 38.

The flanges 44 and 52, the flanges 42 and 48 and the flange 70 and base 47 can be connected together by bolts 71, which are shown joining the flanges 44 and 52, as well as the flanges 42 and 48.

Figure 3:
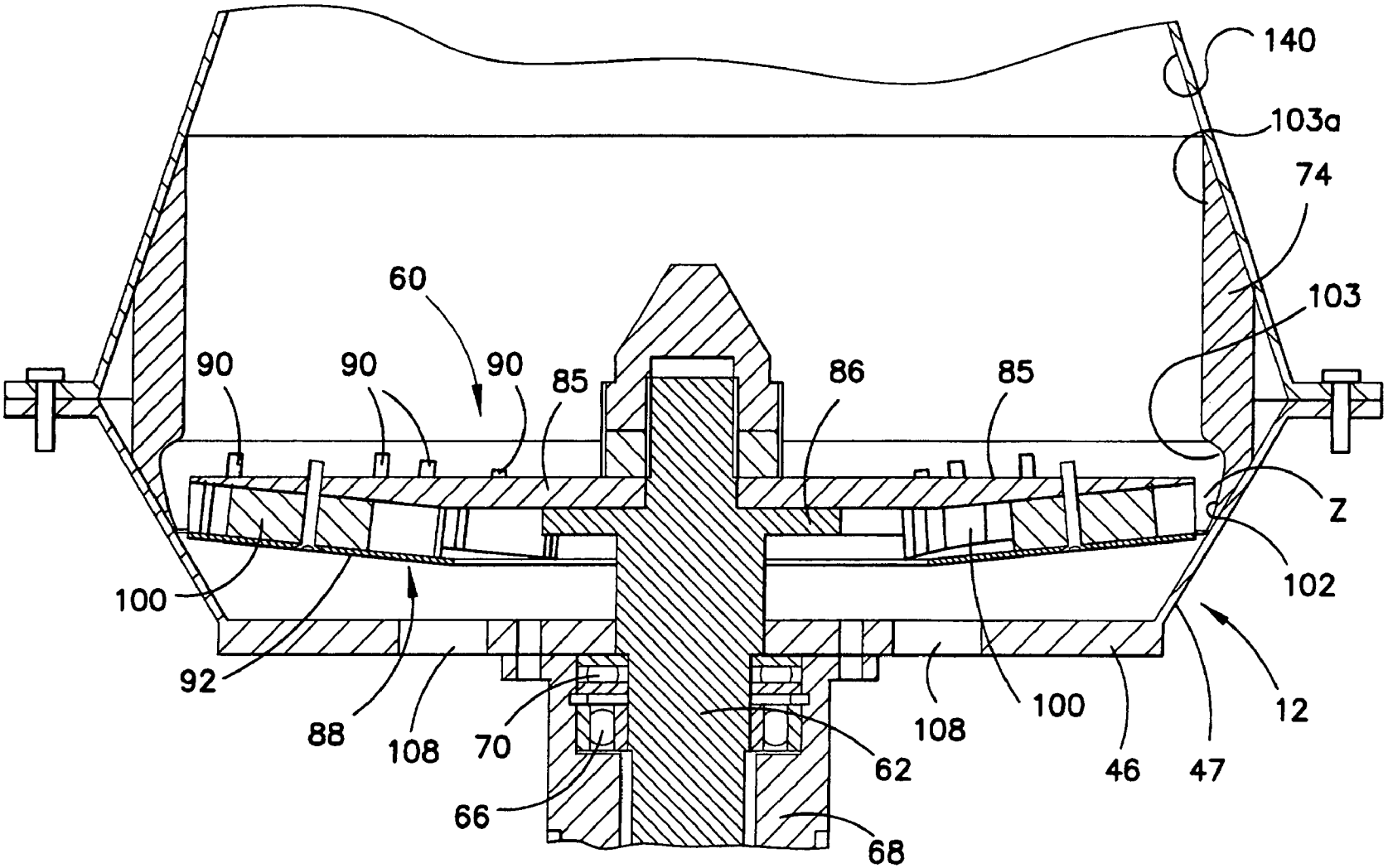
FIG. 3 is a detailed view of part of the grinder housing of FIG. 2.
Figure 4:
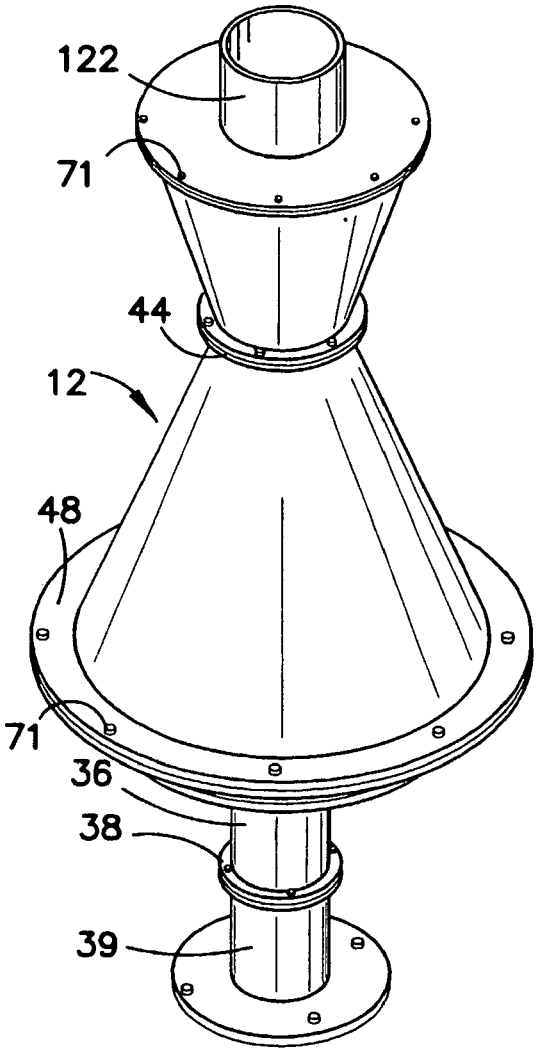
FIG. 4 is a perspective view of a particle grinder according to another embodiment.

If the grinder is to be used for the breakdown of soft or very light material, such as feathers or the like, a separate removable cylinder 74 may be located in the housing 12 as shown in FIGS. 1–3. The cylinder 74 has a recessed contoured wall portion 102 which forms a step 103 with inner wall portion 103*a*. The purpose of this configuration will be described in more detail hereinafter.

The material inlet tube 20 is also used in situations where very soft or light material is to be ground. This tube 20 is also used if liquid or sludge type material is to be broken down by the grinder. In the case of light or soft material, the material can be directed through the tube 20 with an airflow injected into the tube 20 for carrying that material along the tube 20 to outlet end 80. As is shown in FIG. 2, the outlet end 80 terminates at a distance radially outward from the centre of the disc 50. The location of the end 80 is selected so that at that position of the disc, the kinetic energy which will be imparted to the material exiting the end 80 is such that the material will be bounced off the disc and will not merely stick to or sit on the disc. In the case of sludge or other liquid material, if the sludge or liquid material is deposited on a central portion of the disc, it is possible that the speed of rotation at that point will not be sufficient enough to impart sufficient kinetic energy to the disc to cause the material to be flung from the disc towards the wall 40. The material may well just stick to the disc or sit on the disc, and therefore not undergo breakdown. By directing the material to a radially outer part of the disc, the material will initially have sufficient kinetic energy imparted to it by the rotating disc to cause the material to bounce from the disc towards the wall 40 so that the collisions will occur which will break down the material.

As is best shown in FIG. 3, the disc 60 comprises an upper plate 85 which is supported on flange 86 of the shaft 62. A lower plate 88 is arranged below the plate 85 and connected to the plate 85 by bolts or other suitable fasteners 90. The plate 85 has a bevelled lower surface 90 and the plate 88 has an outer peripheral part 92 which is angled with respect to the remainder of the plate 88 so as to be substantially parallel to the lower bevelled surface 90. A plurality of vanes 100 are provided between the surface 90 and the inclined part 92 of the lower plate 88.

The inner wall 74 has a contoured wall portion 102 adjacent the periphery of the disc 60.

When the disc 60 is rotated, the disc 60 creates an annular or a circular air flow adjacent the periphery of the disc 60 between the disc 60 and the wall 74. By angling the vanes 100 upwardly, as is shown in FIG. 3, the circular air flow is directed upwardly along inner wall of the casing 40 (or cylinder 74 if in place) to facilitate spill of the annular air flow up along the inner wall 40 towards the outlet, which in the embodiment of FIGS. 1 and 2 is formed by the pipe 16 in cap casing 50.

The base 47 of the casing part 46 has a plurality of air inlet openings 108 which also facilitate spillage of air up along the inner wall 40. Air can enter the inlets 108 and is drawn by the low pressure environment at the periphery of the disc (as will be described in more detail hereinafter) so as to tend to push the annular air stream at the periphery of the disc upwardly along the wall 40.

Figure 5:
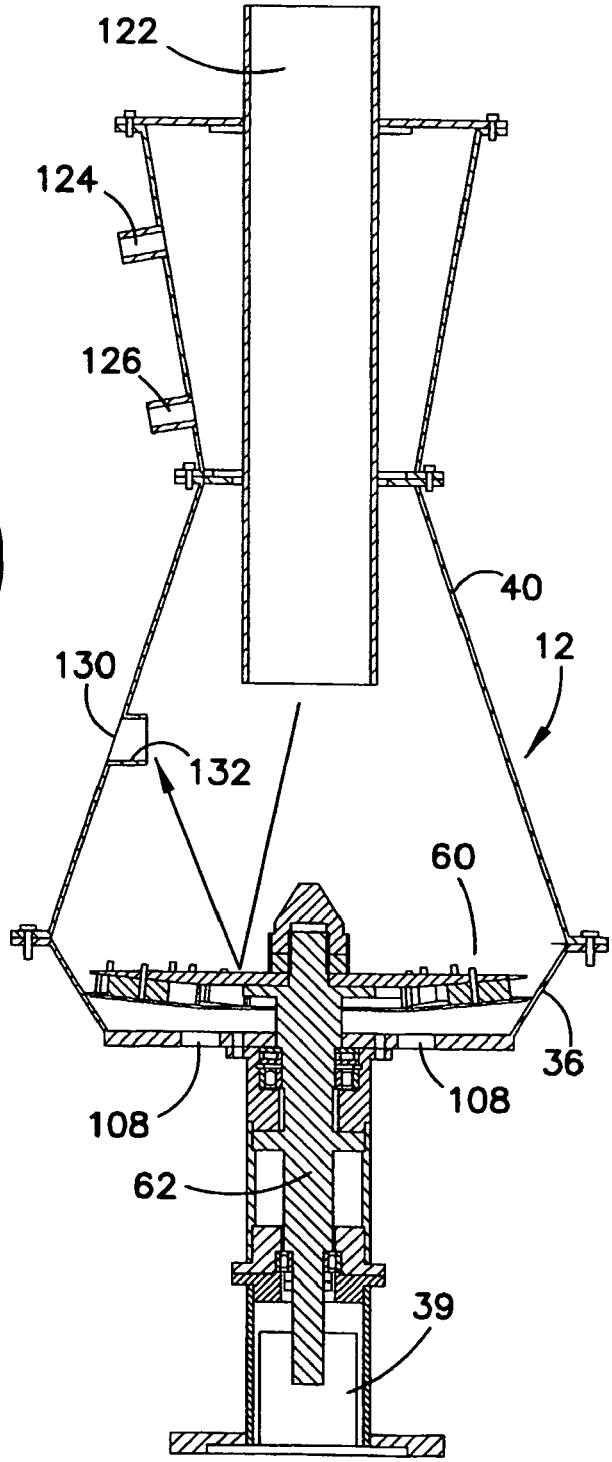
FIG. 5 is a cross-sectional view through the embodiment of FIG. 4.
Figure 6:
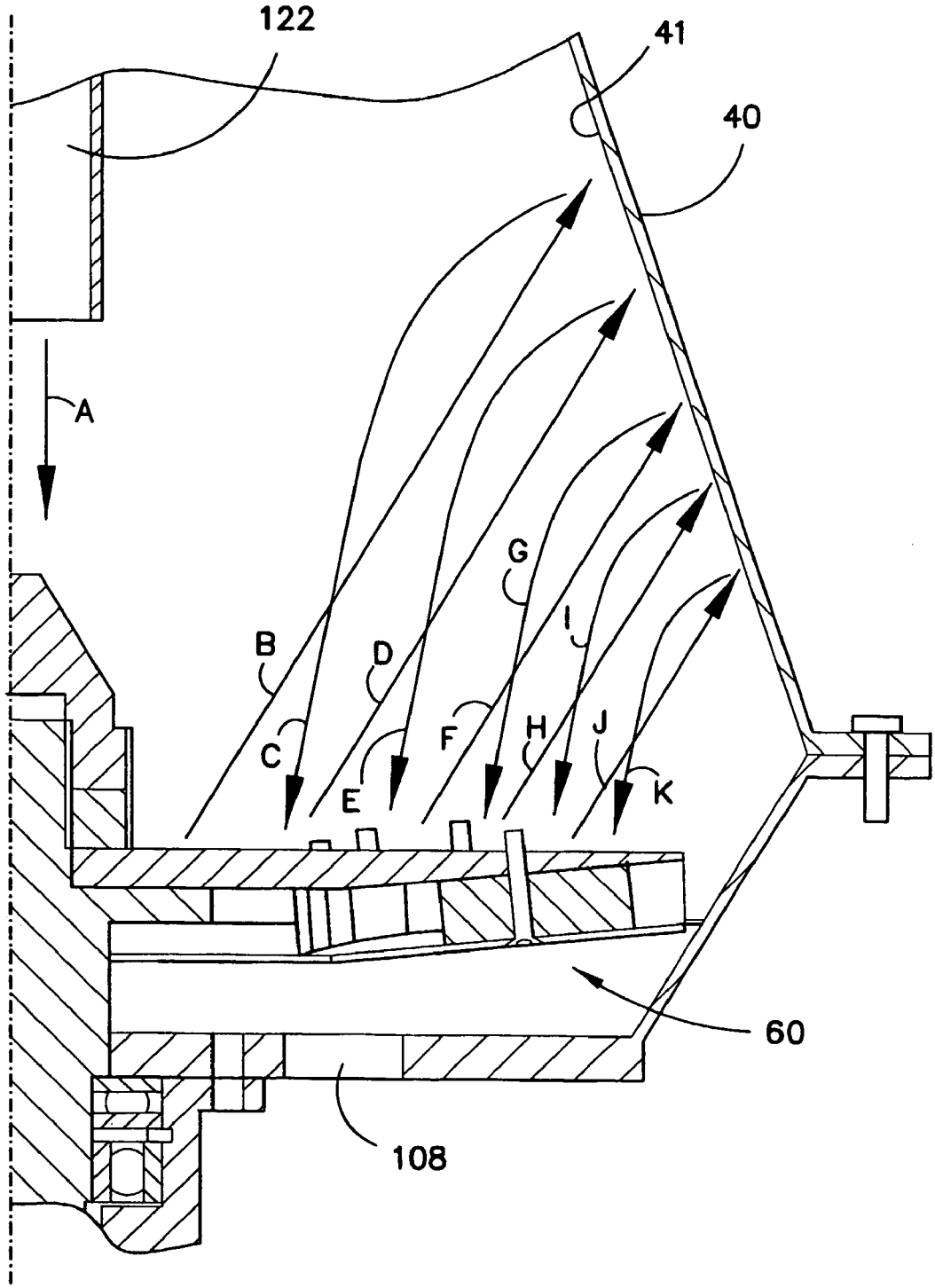
FIG. 6 is a schematic view showing particle breakdown and illustrates energy intensification during particle breakdown.

FIGS. 5 and 6 show a second embodiment of the invention in which like reference numerals indicate like paths to those previously described. Thus, the disc 60, casing 40, casing 46 and shaft 62 are exactly the same as previously described. The disc 60 also creates the annular air flow in the same manner as previously described. In this embodiment, the cap 50 is replaced by an upper conical casing 120 which carries a material inlet 122, which is arranged substantially centrally with respect to the disc 60. This embodiment is intended to be used to break down relatively large or heavy material (gross material) which is unlikely to stick or sit on the rotating disc 60 and therefore can be, and most desirable is, deposited generally centrally on the disc 60 rather than some distance radially outwardly of the disc 60 as in the case of the embodiment of FIGS. 1–3.

The casing 120 has a plurality of outlet openings 124 and 126 which are formed in the conical wall of the casing 120. The outlet openings provide for separation of particles of different sizes carried by the air flow which spills up the inner surface of the casing 40 and then up the inner surface of the casing 120. This separation process will be described in more detail hereinafter.

Also, in the embodiment of FIG. 5, the grinder may be used to separate conglomerate material such that stones or pebbles of a particular size which are fed into the grinder through the inlet 122 initially deflect off the disc 60 and are collected at outlet 130. Material of a different size remains in the grinder and is broken down in the manner which will be described hereinafter. In this embodiment, a shelf 132 could be provided below the opening 130 to facilitate removal of the material from the opening 130. This simply enables conglomerate material to be loaded into the grinder and for a particular particle size to be initially collected without any substantial breakdown because that particle size will initially deflect from the mid portion of the disc to the region of the opening 130 for collection. Smaller and larger particles will tend to travel upon different trajectories towards the wall 40 and therefore collide with the wall 40 for breakdown into smaller particle size, as will be described hereinafter.

FIG. 6 shows breakdown of gross material, such as that in a size range of 100 mm to 300 mm. The gross material is deposited into the grinder from above the disc 60 through inlet 122 (FIG. 6). A lump of material dropped into the inlet 122 will fall (arrow A) on the disc at a first location near the centre of the disc and will absorb momentum and be thrown by centrifugal force (arrow B) against the internal surface 41 of the inverted conical casing 40. The material will begin initial breakdown on first impact with the disc 60 and then on impact with the internal surface 41. The material will then fall, depending on its size, back towards the disc 60 (arrow C), and contact the disc 60 at a second position on the disc 60 radially outwardly of the first position. That impact will again cause breakdown and throw the material towards the inner surface 41 (arrow D) where further breakdown will occur and the material will again fall (arrow E) towards the disc 60 for a still further impact, still further radially outwardly, of the disc 60. This process continues as the material is bounced back and forward between the disc 60 and the internal surface 41 as shown by arrow F, G, H, I, J and K. These impacts will therefore break up the material into smaller particle size. The shape of the casing 40 which is an inverted cone will deflect the material impinging on the inner surface 41 back towards the disc 60 so that it impinges on the disc 60 radially outwardly from the previous impact position a distance not too far radially outwardly from the initial impact. Thus, several impacts with the disc 60 and the inner wall 41 will occur as the material breaks down and gradually moves towards the outer periphery of the disc 60. As is apparent from FIG. 6, the initial impact of the material falling in the direction of arrow A is close to the centre of the disc and therefore impacts on a part of the disc which is rotating at slower speed than points of the disc radially outwardly towards the periphery of the disc. That is, whilst all points of the disc on a radial line are travelling with the same angular velocity, the actual speed of each point increases radially outwardly because of the increased distance traversed by that point during each revolution of that disc. Since the initial impact below arrow A is inwardly of the disc, the amount of energy imparted to the material is relatively small. As the material bounces back and forward between the disc and the wall 40, and falls on radially more outward parts of the disc 60, the speed of the disc is greater at those positions of impact, thereby imparting increased kinetic energy to the material. Thus, the bouncing back and forward of the material between the disc 60 and the wall 40 intensifies the kinetic energy of the material, thereby increasing the energy of the material for particle to particle collisions and also collisions with the wall 40 and the disc 60. These collisions break down the material into ever smaller sizes, with the smaller size particles gradually finding their way towards the periphery of the disc 60.

It should also be noted in FIG. 6 that the direction a piece of material travels after deflection from the wall 40 and the direction a piece of material travels towards the wall 40 are almost linear, or in other words head-on, thereby causing maximum impact in particle to particle collisions as the material bounces back and forward between the disc 60 and wall 40.

It should of course be understood that the movement of the material between the disc 60 and the wall 40 is somewhat chaotic because of the breakdown of the material and therefore the change in size of the material, as well as the angle of collisions, which will deflect the material in various different directions. However, the general travel of material as the material breaks down will be in accordance with the arrows shown in FIG. 6, whereby relatively large material commences impact at a radially inner location of the disc with gradually smaller particles during the breakdown process finding their way towards the edge of the disc, and in general, a significant number of collisions between the disc 60 and the wall 40 may well take place before the material has broken down to a small size where it forms relatively small particles towards the periphery of the disc 60.

Whilst it is preferred that the wall 40 have an inverted conical shape, as is shown in FIGS. 1–6, a wall shape of other configurations, such as generally cylindrical, are also possible. However, a cylindrical has a disadvantage that material deflected from the wall is likely to initially land a greater distance towards the periphery of the disc as it rebounds from the wall, thereby decreasing the number of impacts which occur between the rotating disc and the wall 40. The reason for this is that the point of impact on the cylindrical wall will always be outwardly of the disc, and therefore the trajectory of the material back onto the disc is likely to take the material to a radially more outer location on the disc. Because the conical wall effectively extends inwardly and over the disc 60, impacts of material travelling in the direction of arrow B occur above a midpoint of the distance between the centre of the disc 60 and the periphery of the disc 60 and the trajectory back onto the disc 60 is likely to take the material much closer to its initial impact position than if a cylindrical wall is used.

The breakdown mechanism described with reference to FIG. 6, which relates to generally larger and heavy particles which are deposited from inlet 122 on a central portion of disc 60, can also apply to smaller particles. The smaller particles will bounce back and forward between the disc in a somewhat similar fashion to that shown in FIG. 6, except the initial impact with the disc is radially outwardly of the centre, so its efficient kinetic energy is imparted to the material to cause the material to bounce up towards the wall 40.

When material is ground in the manner in which we described hereinafter, at least some of that ground material moves up the housing 12 to outlet tube 16. As previously explained, the outlet tube 16 supplies the ground particles to the cyclone 14. The cyclone 14 can be used to collect the fine ground particles and also to provide some separation of particle sizes.

FIG. 5 shows another technique for separating particles of different sizes as the particles travel up the inner surface of wall 40. In this embodiment, outlets 124 and 126 are formed at different heights above the disc 60 in the conical top casing 120. The formation of the outlets in the conical wall 120 is important, because it has been found that if an outlet is formed in the inverted conical wall 40, or if more than one outlet is formed in the inverted conical wall 40, all of the material tends to exit that outlet and does not separate through the additional outlets depending on size. Some of the fine material, as previously mentioned, may pass the outlet and require extraction by the cyclone or simply circulate in the grinder. However, if the plurality of outlets, such as the outlets 124 and 126, are formed in the conical wall 120, separation of particle sizes does take place because the relatively larger particles, as they flow up the inclined wall formed by the conical housing 120, can tend to drop into the outlet 126 with the smaller particles remaining in the air stream, and then drop into the higher opening 124 as their energy, or speed of motion in the air stream reduces. The reason why the separation appears to occur in the conical section 120 rather than in the section 40 is due to the respective angles of the wall and the fact that the inverted cone 40 tends to allow all of the very small particles to exit the first opening the material comes across because of the angle that opening makes with respect to the direction of air travel up the incline wall 40, whereas the angle of the wall 120 allows the even smaller particles to travel past lower openings in the airflow towards the opening above that lower opening for collection in the higher opening.

Figure 7:
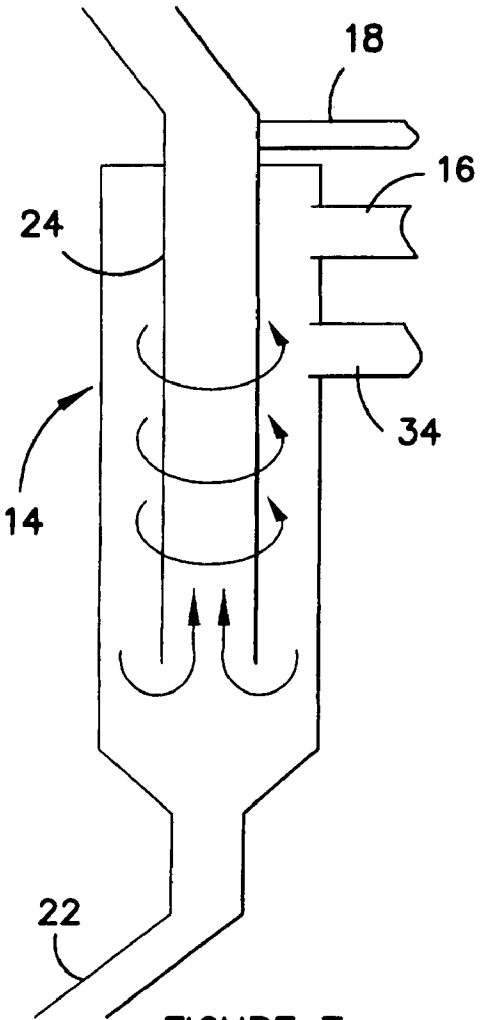
FIG. 7 is a cross-sectional view through a cyclone collector shown in FIG. 1.

As is shown by FIG. 7, fine particles could be collected by the outlet 16 and conveyed to cyclone separator 14 if desired. Whilst the cyclone is suitable for collecting very fine particles, the cyclone could also be used for collecting larger particles and the openings 119, 126 or 124, previously described, could be connected to the cyclone 16 so that the particles collected from that outlet are separated from the airflow in the cyclone 14.

The air and particulate material which exits the outlet 16 is supplied to the cyclone 14. The air supply through the outlet 16 to the cyclone 14 is directed tangentially into the cylindrical cyclone 14 as shown in FIG. 1, so as to create a generally circular or cyclonic flow of air in the cyclone 14. The circular or cyclonic air flow in the cyclone 14 is also supported by entry of hot air into the hot air inlet tube 34, which is also arranged tangentially with respect to the cyclone 14.

As is shown in FIG. 7, the particles which enter the cyclone 14 from the tube 16 are entrained in the air flow which creates the circular or cyclonic air flow within the cyclone 14, or which merges in with the cyclonic air flow caused by the hot air introduced through the inlet 34.

The cyclonic air flow within the housing 14 separates the particles from the air flow so that the particles are able to drop under the influence of gravity into particle outlet 22 whilst the air is able to exit the cyclone 40 through air outlet tube 24.

The outlet tube 24 will generally be at higher pressure than the reduced pressure region in the centre of the housing 12 and the air inlet 18 can therefore be connected to the outlet tube 24 for the supply of air back into the housing 12 through the inlet 18. Any very small particles which are still trapped in the air flow in the outlet 24 therefore have the opportunity to pass back into the housing 12 for reprocessing.

In other embodiments (not shown), as well as or instead of the cyclone 14, electrostatic or magnetic precipitators, or gas scrubbers, could also be used for removing fine particles. The electrostatic or magnetic precipitators or gas scrubbers could be used in the inlet 18 shown in FIG. 1 to remove the small particles so they do not just continuously circulate. Furthermore, such devices may also be used on the outlet 24 from the cyclone.

As previously mentioned, if desired, hot air can be supplied to the housing 12 through hot air inlet 32 (not shown in FIGS. 2 and 3). The supply of hot air is useful if it is desired to dry the material which is being broken down by the grinder and, in particular, if the material is in a semi-gas or wet condition.

In other applications where the supply of hot air is undesirable (such as the breakdown of coal or the like, which may ignite or explode during breakdown), the valve 30 can be shut off to ensure that no hot air is supplied to the housing 12. In other embodiments, the inlet 32 could be connected to an inert gas supply for supplying inert gas in the event of breakdown of volatile materials such as coal or the like, to eliminate the possibility of ignition or explosion of the material during breakdown in the grinder 12.

Figure 8:
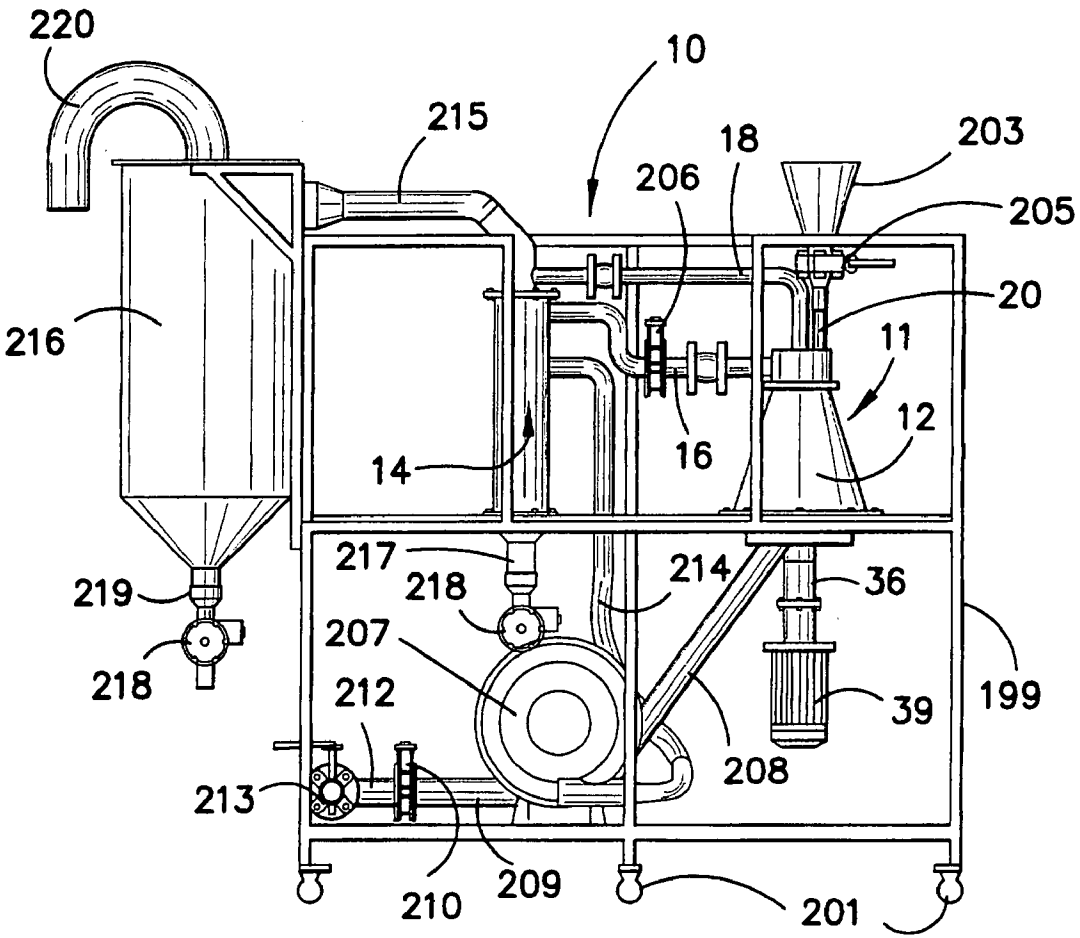
FIG. 8 is a view of a second embodiment of the invention.

FIG. 8 shows a second embodiment which is similar to the embodiment of FIG. 1. Like reference numerals indicate like parts to those previously described.

The grinder installation 11 is supported in a support frame 199 which could be mounted on wheels or casters 201 to enable the support frame and grinder to be moved from place to place. Alternatively, the support frame 199 may simply be fixed to the ground or floor. Support frame 199 merely supports all of the components of the grinder installation 11. In this embodiment, inlet tube 20 is vertical and is connected to a hopper 203. The hopper 203 may be connected to the inlet tube 20 by a feed regulating valve 205 so that, if desired, material in the hopper 203 can be feed in a controlled manner to the housing 12. The outlet tube 16 may also have a regulating valve 206 to control flow of ground small particles through the outlet 16 to the cyclone 14. A first blower 207 is provided for blowing air through air tube 208 to the housing 12. The air tube 208 may communicate with at least one of the holes 108 (see FIG. 9 in the housing 12). Alternatively, the tube 200 may connect to a manifold (not shown) which in turn communicates with the interior of the housing 12 to supply air into the housing 12. Air is supplied into the blower 207 through inlet 209 and valve 210. A second blower (not shown) is located behind the blower 207 and air is supplied into the second blower via inlet 212 and valve 213. The second blower 213 has an outlet tube 214 which supplies air into the cyclone 14 for increasing the speed of the vortex or cyclonic airflow within the cyclone 14.

Figure 10:
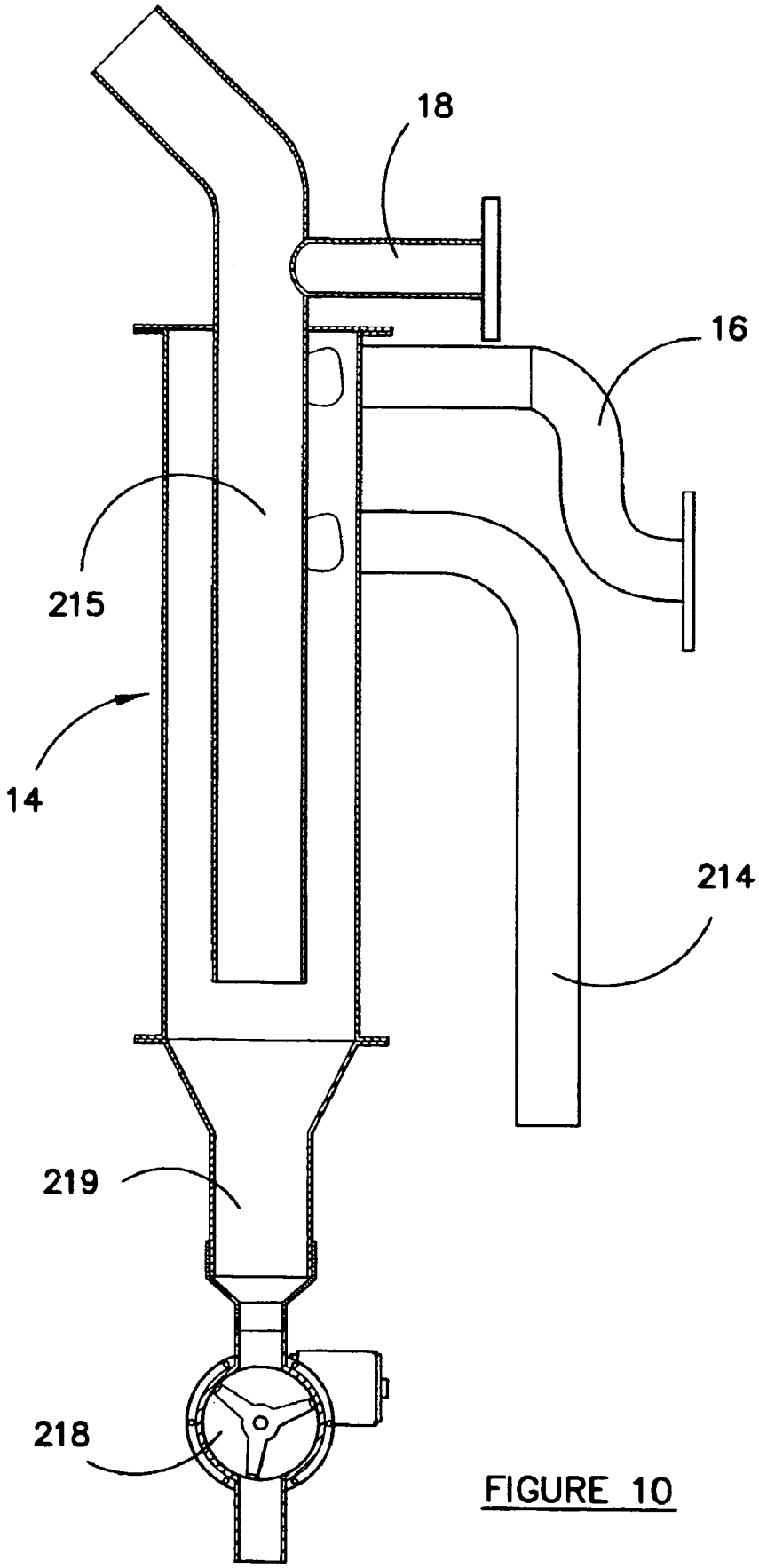
FIG. 10 is a cross-sectional view through a first cyclone used in the embodiment of FIG. 8.
Figure 11:
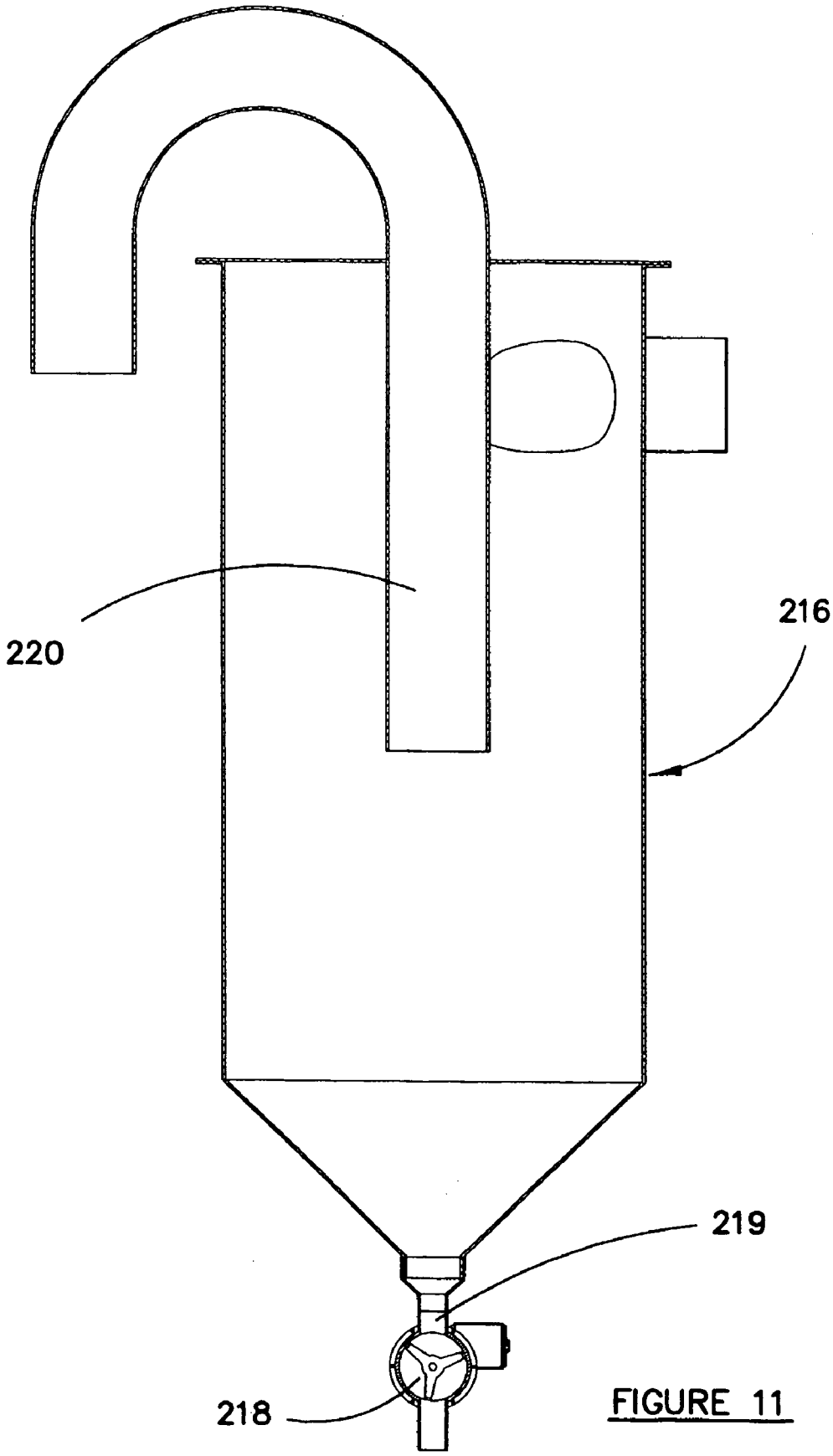
FIG. 11 is a view of a second cyclone used in the embodiment of FIG. 8.

Air exhaust 18 from the housing 12 connects to air exhaust outlet pipe 215 from the cyclone 14 and the outlet pipe 215 is connected to a second cyclone 216. The cyclone 14 has a small particle outlet 217 which is provided with a gas lock 218 (see FIG. 10), and the cyclone 216 is provided with a small particles outlet 219 which is also provided with a gas lock 218 (see FIG. 11). The gas locks 218 allow the small particles to pass through the gas locks but not the high pressure air in the cyclones. The cyclone 216 also has an air exhaust 220.

Thus, ground particle which exit the housing 12 through the outlet tube 16 are provided to the cyclone 14 where the particles are separated from the airflow and which can be collected in a container (not shown) arranged below the particles outlet 217. Air exits the cyclone 14 through outlet tube 215 and any very small particles which are still entrained in that airflow are supplied to the second cyclone 216. Those particles are separated in the cyclone 216 and are collected in a container (not shown) below the particles outlet 219. The air supplied to the cyclone 216 from the outlet tube 215 exhausts from the cyclone 216 through exhaust outlet tube 220. The outlet tube 220 may be connected to a final filter or scrubber for collecting the very fine particles which may remain entrained in the airflow exhausted from the second cyclone 216.

Figure 12:
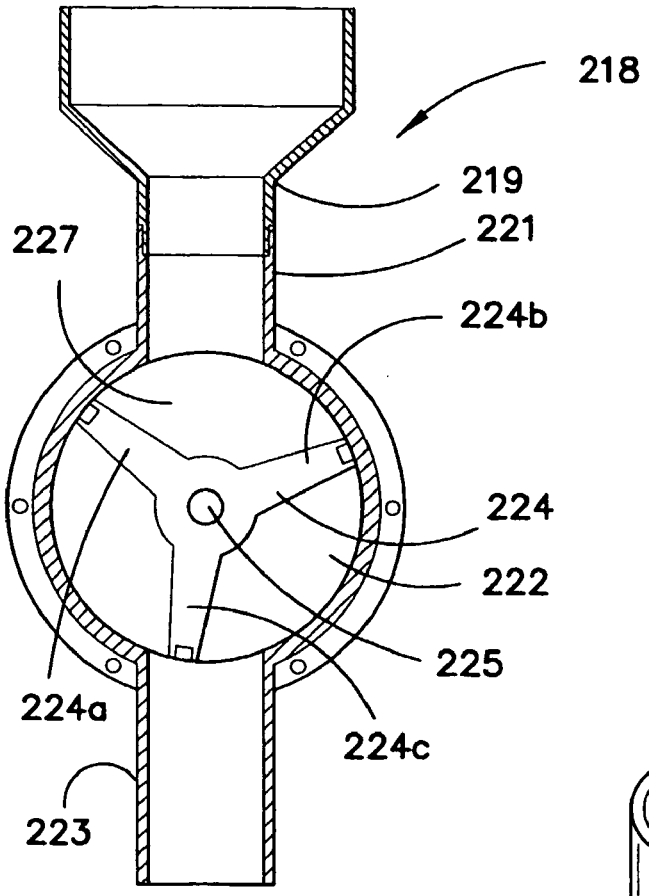
FIGS. 12 and 13 show a gas lock used in the embodiment of FIG. 8.
Figure 13:
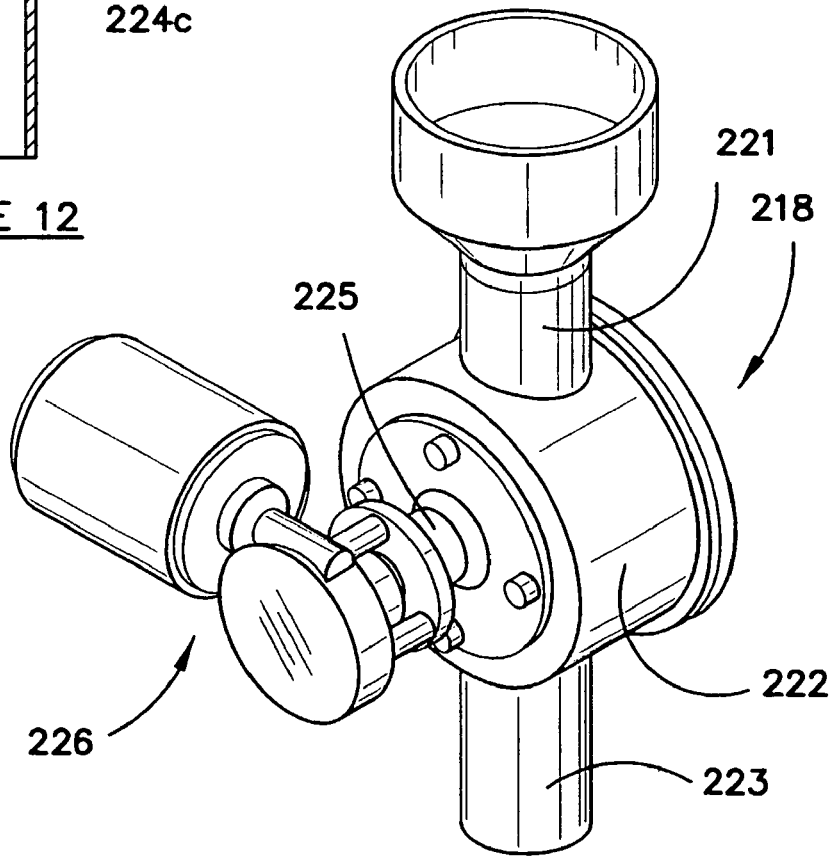

The gas locks 218 are shown in FIGS. 12 and 13 and comprise an inlet tube 221 which connects to the outlet 219 (or the outlet 217 as the case may be), the inlet 221 is in communication with a cylindrical chamber 222. The cylindrical chamber 222 has an outlet tube 223. A rotor 224 is mounted for rotation within the cylindrical chamber 222 and has three vanes 224*a*, 224*b*, and 224*c*. The rotor 224 is mounted on an axle 225. As is shown in FIG. 13, the axle 225 is driven by an electrical motor 226 so that the rotor 222 rotates about the axis of the axle 225.

Thus, small particle material which enters the inlet 221 collects in the space 227 between the vanes 224*a* and 224*b*. The particles which are collected in the space between the vanes 224*b* and 224*c* is allowed to drop through the outlet 223 and the space between the vanes 224*a* and 224*c* is empty. Thus, the outlet 223 is always sealed from the inlet 221 by the rotor 222 so that relatively high pressure air in the cyclone 216 (or 214 as the case may be) is not able to communicate with the outlet 223. This allows the fine ground material to simply drop under gravity out of the space between the adjacent pair of rotors as that space comes into communication with the outlet tube 223 and therefore will not be blown out in a cloud of fine dust, which may otherwise happen if the gas lock 218 was not provided. Thus, the spaces between adjacent vanes 224*a*, 224*b* or 224*c* are sequentially filled with fine ground material and are emptied as those spaces move into communication with the outlet tube 223 so that the small particles simply drop under the influence of gravity into the container (not shown) located below the outlet 223.

Figure 9:
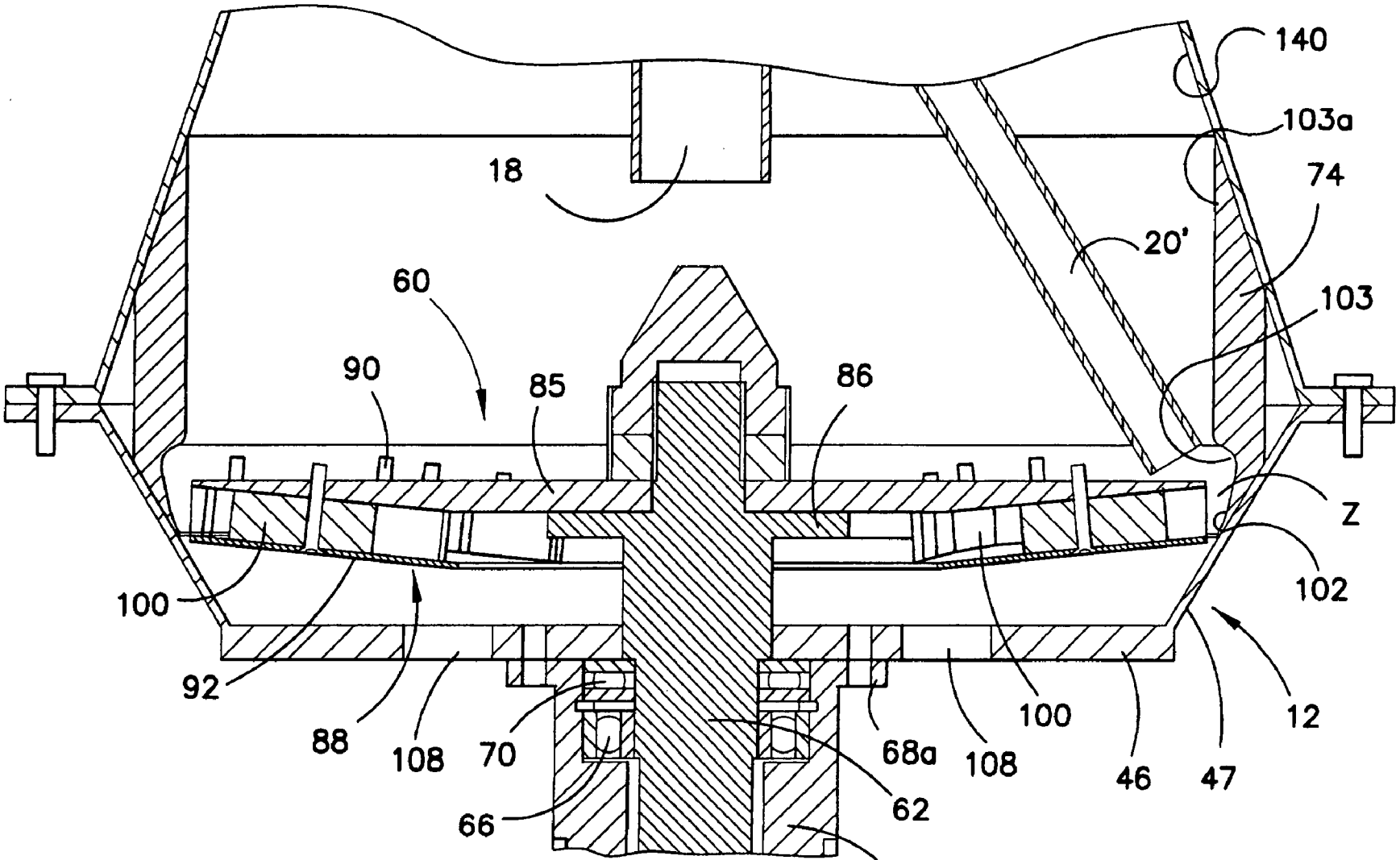
FIG. 9 is a detailed cross-sectional view of a grinding housing according to the embodiment of FIG. 8.

FIG. 9 is a detailed view of disc 60 within the housing 12. This arrangement is basically the same as that shown in FIG. 3 and, once again, like reference numerals indicate like parts to those described with reference to FIG. 3. However, in this embodiment the inlet 20 is extended by an inlet pipe 20' which has an outlet adjacent the periphery of the disc 60.

This embodiment is particularly suitable for grinding smaller particles such as sand or the like which have a size less than 10 mm. In this embodiment the material is deposited directly at the periphery adjacent main grinding zone Z which will actually produce the very small particles for collection. The grinding zone Z is generally between the periphery of the disc 60 and the inner stationary wall 102, and within the confines of the disc 60 (ie. between the top surface and bottom surface of the disc 60). However, the grinding zone Z may extend to a position above the top surface of the disc 60, but still generally between the periphery of the disc 60 and the inner stationary wall 102. The sand may be deposited at the periphery because it is already in a relatively small state, as compared to the gross material previously described which is of much larger size and which needs to be broken down to a smaller size before it is ground in the main grinding zone Z to very small particles which will eventually be collected at the outlets 217, 219 or 220.

The periphery of the disc is spaced from the inner wall 102 by a distance of 10 to 30 mm. However, a larger space could be used depending on the nature of the material to be ground. The disc is about 400 mm in diameter and is rotated at a speed of about 4500 rpm. The disc has a weight of about 5 to 10 kg. However, obviously larger or smaller machines could be produced by scaling these dimensions.

Figure 9A:
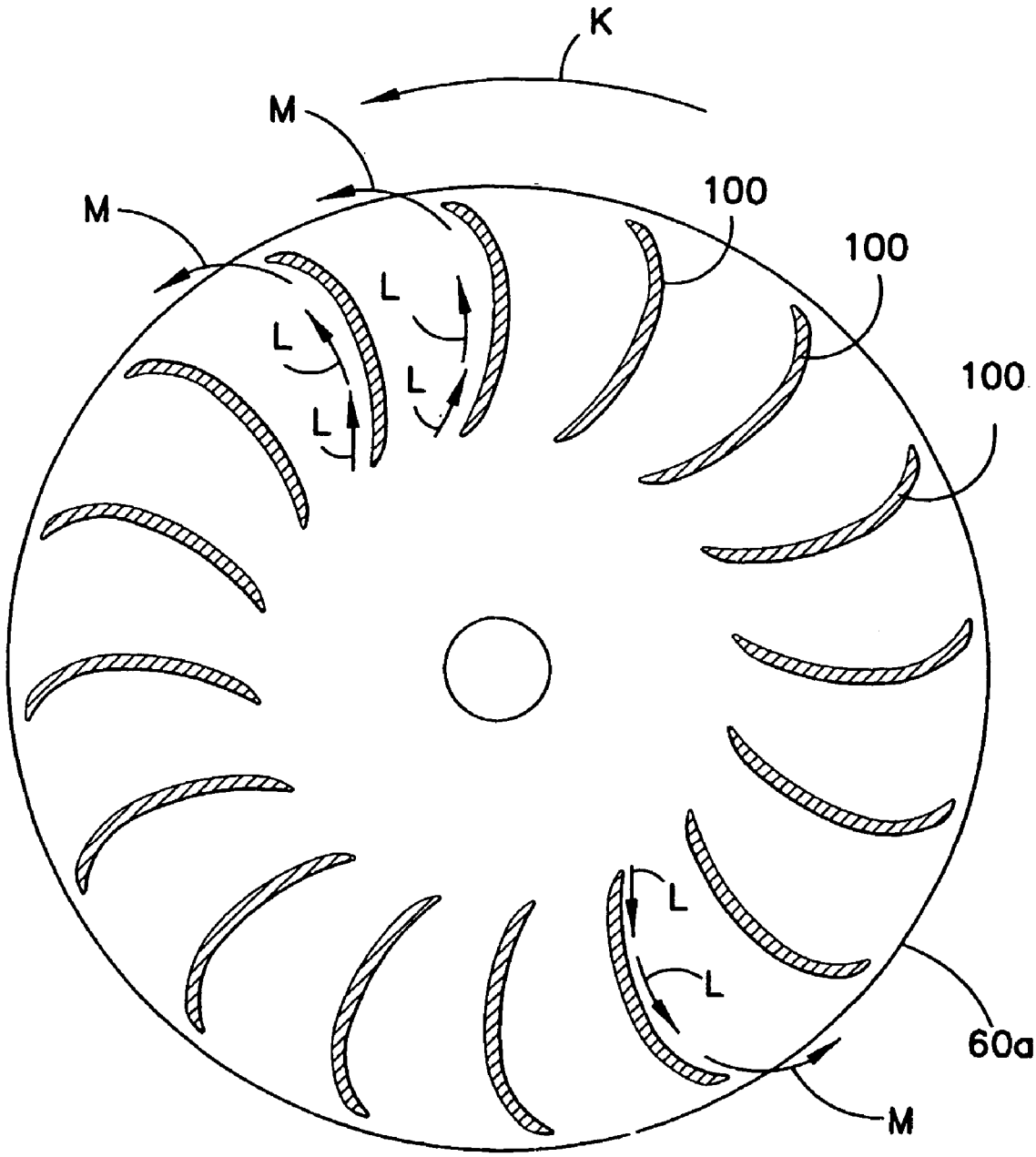
FIG. 9A is an underneath view of a disc used in the preferred embodiments showing the configuration of vanes on the disc.

FIG. 9A shows an underneath view of the disc 60 and, in particular, the configuration of the vanes 100. The vanes 100 are configured so they will drive the air out of the turbine formed by the vanes 100 in the same direction K as the rotation of the disc. Furthermore, the vanes 100 are shaped so that gas particles accelerating, as shown by arrows L, from an inner peripheral portion of the vanes to the periphery of the disc create sufficient acceleration to enable the air to exit in the direction of rotation without producing turbulence (as shown by arrows M). As can be seen in FIG. 9A, the vanes 100 are generally arcuate, with the radius of curvature generally increasing towards the outer periphery of the disc so that the exiting air is as near as possible tangential to the disc 60.

When the disc 60 is rotated, the vanes 100 produce a flow of air from the air which enters the holes 108. The blower 207 may be used to provide an initial speed to the air as the air enters the housing 12 so that that air is collected by the vanes 100 as the disc 60 rotates to produce the high speed airflow at the periphery of the disc 60 generally in the vicinity of the contoured wall 102 which, together with the periphery of the disc 60, generally defines the main grinding zone Z. It should be understood that the blower 217 need not be used and air could simply enter the housing 12 through the openings 108 for collection by the vanes 100. Thus, the vanes 100 and the rotating disc 60 produce a generally lamina airflow at the periphery of the disc which is very fast immediately adjacent the periphery of the disc, and most preferably at least as fast as, if not faster that the speed of the periphery of the disc. The rotating disc, together with the vanes 100, therefore provides energy intensification of the air within the housing 12 at the periphery of the disc in the grinding zone Z. Thus, the stationary air below the disc 60 and within the housing 12 is therefore accelerated up to high speed at the periphery of the disc. If the air is introduced with some speed by the blower 207, then the speed of the air is further accelerated by the disc 60 and vanes 100.

Figure 14:
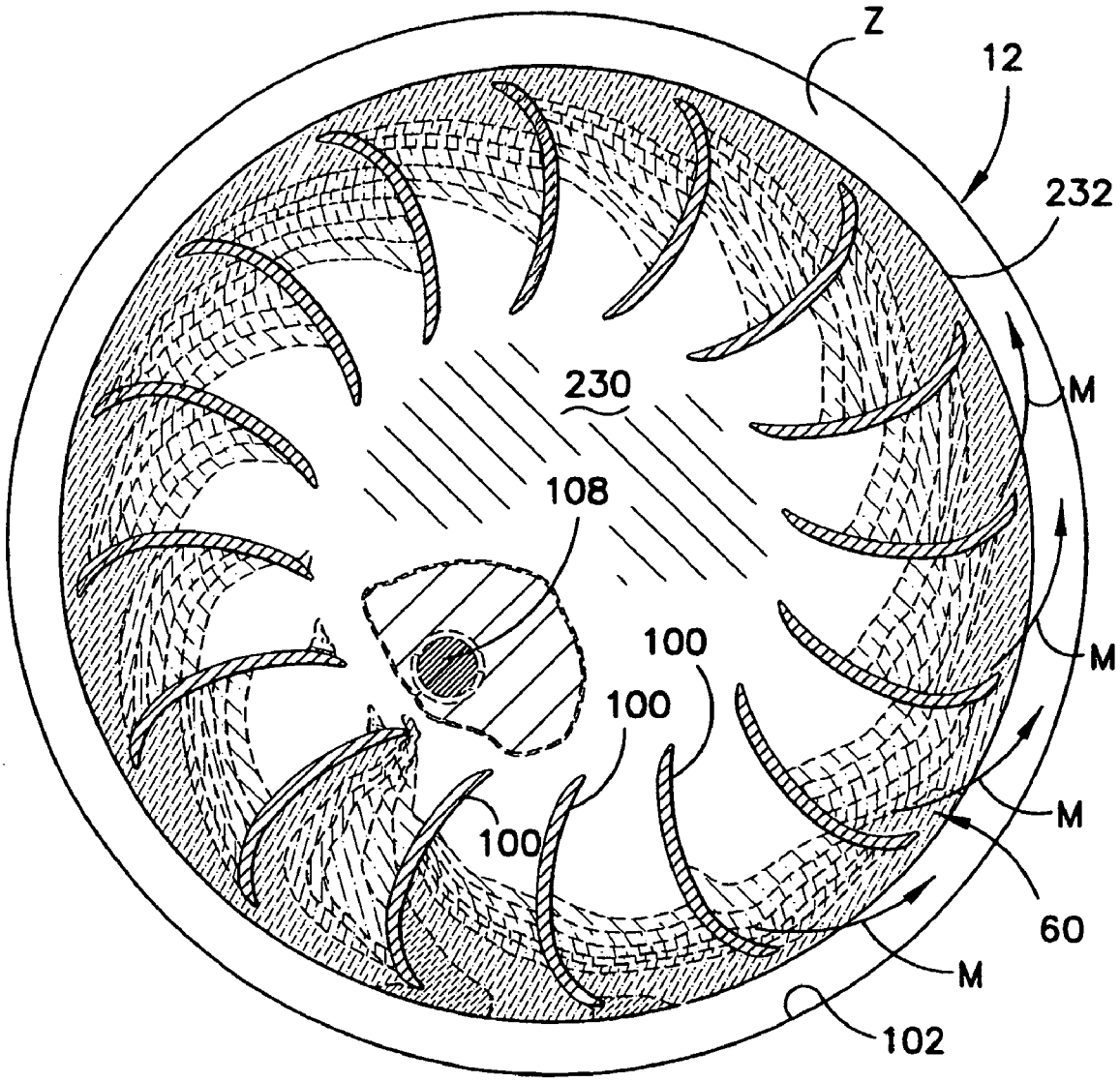
FIG. 14 is a schematic diagram showing pressure variation used to explain the manner in which the embodiments of FIGS. 1 to 7 and 8 to 13 operate.

As is shown in FIG. 14, the pressure differential of air below the disc 60, where it can be seen that the pressure increases from a relatively low pressure region 230 inwardly of the disc to a high pressure region 232 at the periphery of the disc. The closer or more dense cross hatching in FIG. 14 shows increasing pressure regions extending towards the periphery of the disc.

Figure 15:
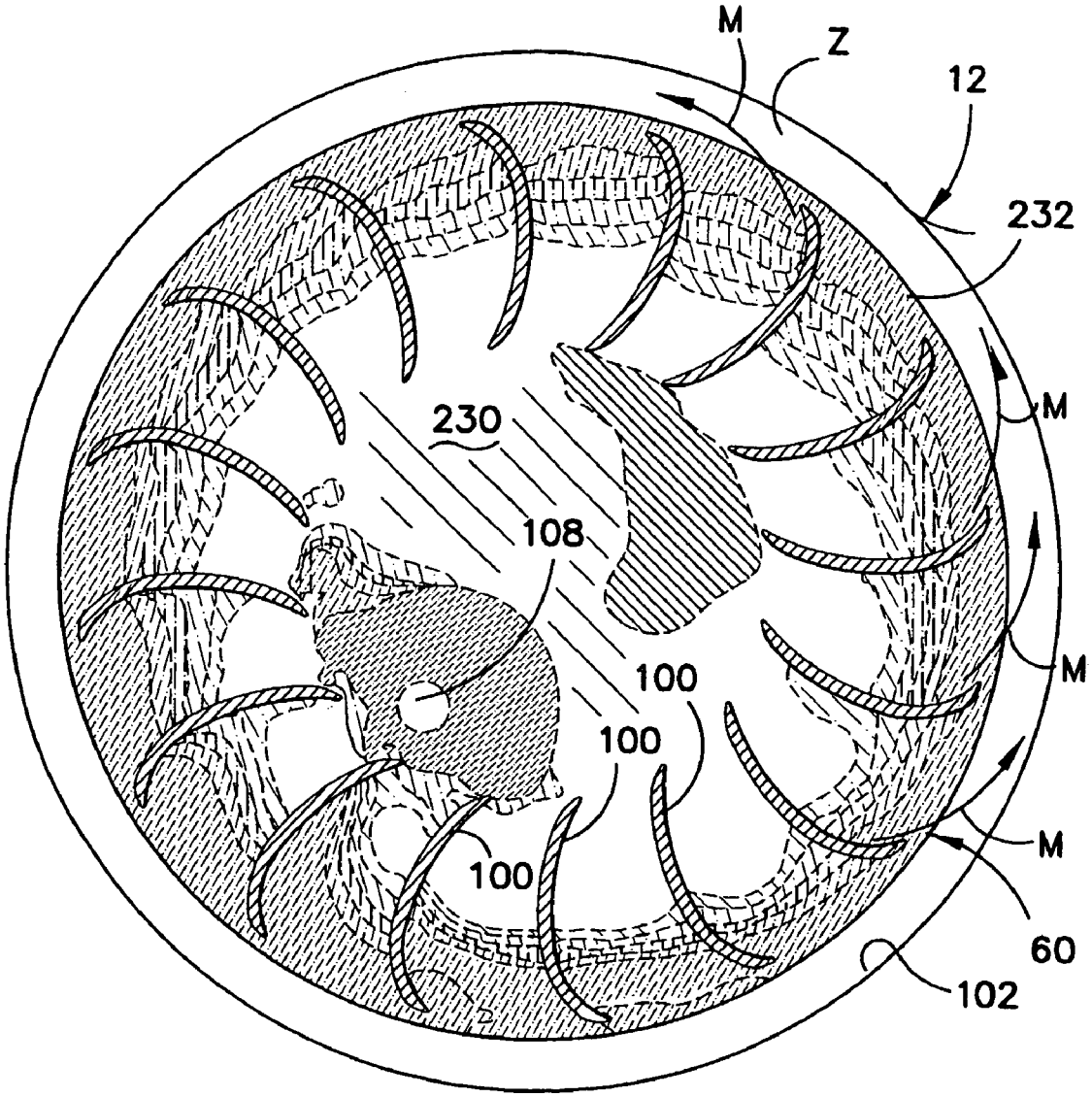
FIG. 15 is a diagram similar to FIG. 14 but showing speed differential.
Figure 16:
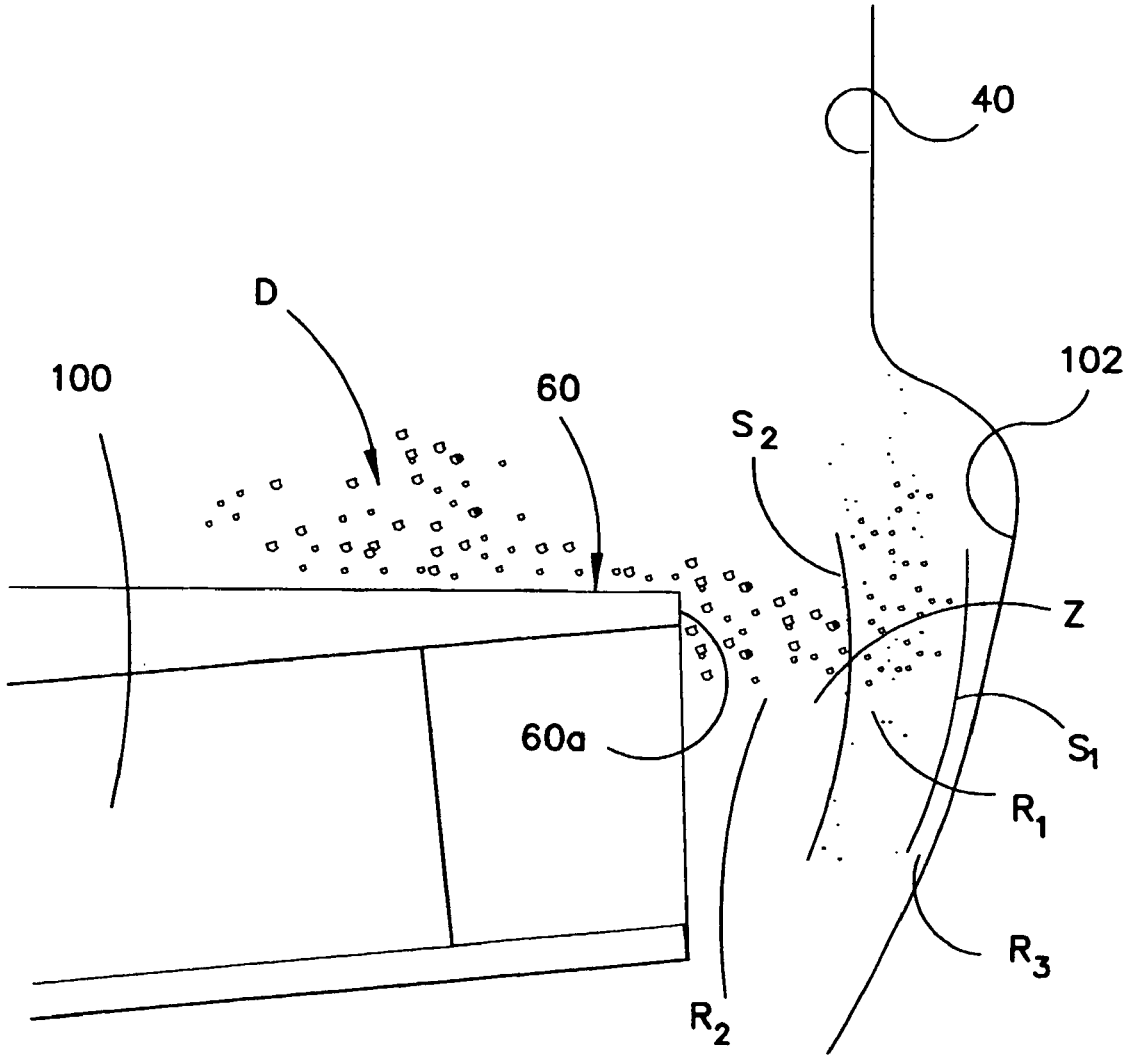
FIG. 16 is a schematic diagram illustrating the primary grinding zone of the preferred embodiments.

FIG. 15 is a diagram similar to FIG. 14, except that the diagram shows the speed differential where the speed of the airflow increases from the position 230 inwardly of the periphery to the region 232 at the periphery of the disc. Again, the more dense cross hatching shows increasing speed. The pressure and speed of the airflow at the periphery of the disc may be in the order of 150,000 Pa and 300 metres per second.

If relatively large particulate material is deposited into the housing 12, such as broken glass which may have a size of about 10 mm or larger material, initial breakdown occurs due to impact with the disc 60 and the side wall of the housing 40 as previously described. Small particles will find their way into the grinding zone Z and further breakdown will occur due to particle to particle collisions in that zone and also possibly some collisions with the wall 102, although these latter collisions are likely to be much fewer than the particle to particle collisions. As the particles begin to break down into small particle sizes, the grinding zone Z starts to establish itself.

The manner in which the material is ground in the grinding zone Z will be described with reference to FIGS. 14 to 17. This form of grinding is applicable to both the embodiments of FIGS. 1 to 7 and 8 to 13. Small particles in the housing 12 will eventually find their way to the periphery of the disc 60. This can happen by breakdown of large gross material in the manner described with reference to FIG. 6, or by depositing smaller material through the tube 20' at the periphery of the disc 60. In both cases, the material in relatively large particle size, but much smaller than the gross particle size which is broken in the manner described with reference to FIG. 6, therefore tends to enter in the direction of arrow D either directly from the tube 20' or after being broken up by impacts with the disc 60, the wall 40 and particle to particle impact above the disc 60. The kinetic energy of the relatively large particles is therefore intensified as the particles near the disc periphery, and the particles are therefore driven by centrifugal force into the zone $R_1$ shown in FIG. 16.

As the particles begin to break down into smaller particle sizes, a range of particle sizes will be created. Some of those particle sizes will be very small and probably in the order of about 200 to 800 nanometres. These particles are entrained in the annular gas flow created in the grinding zone Z between periphery 60*a* of the disc 60 and the wall 102. This air flow is made up of molecules of the gases making up the air and the small particles held in an aerosol suspension within the air. If the suspended particles are small enough, this air particle mixture will act generally as a gas within a certain range of temperatures and pressures, that is, it will obey gas laws relating to temperature and pressure and increase in kinetic energy of all of the particles when heated. This gas mixture is referred to herein as a heavy gas. This heavy gas generally forms in a region $R_1$ which is radially outwardly of the periphery 60*a* of the disc 60. The reason for this is that the heavy gas is generally pushed out to this region by the gas flow created by the vanes 100. The very small particles which mix with the air molecules to form the heavy gas generally remain in the region $R_1$ outwardly of the periphery of the disc 60 because they are adjacent to a stationary wall, and therefore move more slowly than the newly entering air from the vanes 100. The heavy gas region $R_1$ is therefore moving at a slower speed than the gas in region $R_2$ and which will form a boundary layer which will become the shear zone $S_2$ between the regions $R_1$ and $R_2$ when the larger particles migrated into the grinding zone Z from the disc 60. Thus, if heat is added to the heavy gas, kinetic energy is increased, thereby increasing the grinding effect with little, if any, added mechanical energy. The heavy gas therefore generally acts like a normal gas such as air, but is formed by molecular particles carrying a suspension of larger, but very small particles. The suspended particles usually cannot be filtered or settled in devices like cyclones, and are generally analogous to a liquid colloid suspension. As the heavy gas region $R_1$ builds up, the shear zone $S_2$ is therefore created between the region $R_1$ and the second region $R_2$ between the shear zone $S_2$ and the periphery 60*a* of the disc 60. The region $R_1$ of the heavy gas particles generally forms radially outwardly of the disc 60*a* because of the relatively small size of those particles. A low friction air cushion exists in a region $R_3$ between the wall 102 and the region $R_1$ which moves slower than the heavy gas flow in region $R_1$ and a shear zone $S_1$ is created between the regions $R_3$ and $R_1$. In the region $R_3$, the air is moving very slowly because of contact with the wall $S_1$ and therefore the particles in the region $R_1$ tend not to move into that region, but remain within the region $R_1$ between the shear zone $S_1$ and the $S_1$ and shear zone $S_2$. The larger particles which are initially provided in the region $R_2$ will at random come into contact with the shear zone $S_2$ or pass through the shear zone $S_2$ into the region $R_1$. At the shear zone $S_2$, or if they move into the region $R_1$, they are bombarded by the heavy gas and, in particular, the small particles to cause breakdown of those larger particles into smaller particle sizes. This will in turn form particles of varying sizes and again, some of those particles will be of the very small size which simply add to the heavy gas in the region $R_1$ and others will be slightly larger particles. The region $R_1$ therefore fills with particles, both of a relatively small size to form the heavy gas, and also slightly larger sizes. Thus, some of the particles which pass through the shear zone $S_2$ or which simply arrive at the shear zone $S_2$ are comminuted into heavy gas particles by collision with existing heavy gas particles in the region $R_1$ and at the shear zone $S_2$. Some of the particles which are communicated are not sufficiently small to behave as heavy gas particles, and some of those particles will be quickly ejected back to the region $R_2$. This is because the differential air speeds of the heavy gas and the newly introduced gas from the vanes 100 will have a pressure difference. However, as the number of particles in the region $R_1$ and $R_2$ tends to build up, in the annular flow of air between the periphery of the disc 60*a* and the shear zone $S_1$, some of the particles will tend to spill upwardly out of the shear zone Z along the wall 102. Movement of the particles in this direction is facilitated by the upwardly directed flow of air which is created by the vanes 100.

The particles which move out of the grinding zone Z will be largely particles which have entered the heavy gas region $R_1$ and which are broken down into smaller particle sizes, but not sufficiently small to act as a heavy gas, together with some of the heavy gas particles, and also some of the particles from the region $R_2$ which are still relatively large.

Of those particles which leave the region Z, most of the heavy particles will tend-to move into a complex field created above the disc 60, and which will be described in more detail hereinafter, and will be recirculated back down onto the disc 60 to migrate back to the grinding zone Z for further grinding. However, some of those larger particles, together with small particles, and also some heavy gas particles and small particles which are created in the grinding zone Z will either move with the upwardly moving air stream to the outlet 16, or be entrained in the exhaust gas exhausted from the housing 12 through the exhaust outlet 18.

Because the disc 60 has a plurality of vanes 100 and is rotating relatively fast, a very stable and coherent annular generally laminar flow of air is created at the grinding zone Z which is directed slightly upwardly relative to the disc 60 and therefore, a stable and coherent annular grinding zone Z is created in the annular region around the disc 60 between the periphery 60*a* and the wall 102, to therefore form a grinding zone Z which has a substantial size. The continued pumping of air into the grinding zone from the plurality of vanes 100 ensures that the airflow within the grinding zone Z is stable and coherent so that the heavy gas region $R_1$ of heavy gas particles is established and maintained.

Thus, a stable and coherent grinding zone Z is built up and is maintained between the periphery of the disc 60*a* and the wall 102, which is comprised of the shear zone $S_2$ between the larger particles in region $R_2$ and the heavy gas within the region $R_1$. Because the disc 60 is spaced a relatively small distance from the wall 102 and effectively defines a uniform annular space between the periphery 60*a* and the wall 102, and air is continually fed into that space by the vanes 100 attached to the rotating disc 60 a uniform and coherent heavy gas annulus is maintained in the region $R_1$.

Thus, as larger particles move into the region $R_2$, those particles come into contact with the heavy gas in the region $R_1$ at the shear zone $S_2$ and are further comminuted by particle to particle contact at the shear zone $S_2$ so that those larger particles in the region $R_2$ contribute more fine particles to the heavy gas in the region $R_1$. As the region $R_1$ overfills with fine heavy gas particles and small particles which are larger than the heavy gas particles, those particles begin to spill upwardly along the wall 102.

The high energy environment of the heavy gas annulus in the region $R_1$ will produce other changes in the particles within the region $R_1$. Some of these changes will involve surface molecular dissociation and sublimation and will result in the production of continuously finer particles.

The particles remain in the region $R_1$ for a relatively short time period, and probably significantly less than one revolution of the disc 60 (although very small particles may stay in the region $R_1$for longer), as will be described in more detail with reference to FIG. 18. The particles therefore leave the grinding zone Z quite quickly and pass through the complex vector field above the disc 60. This complex field is shown in FIG. 17.

Figure 17:
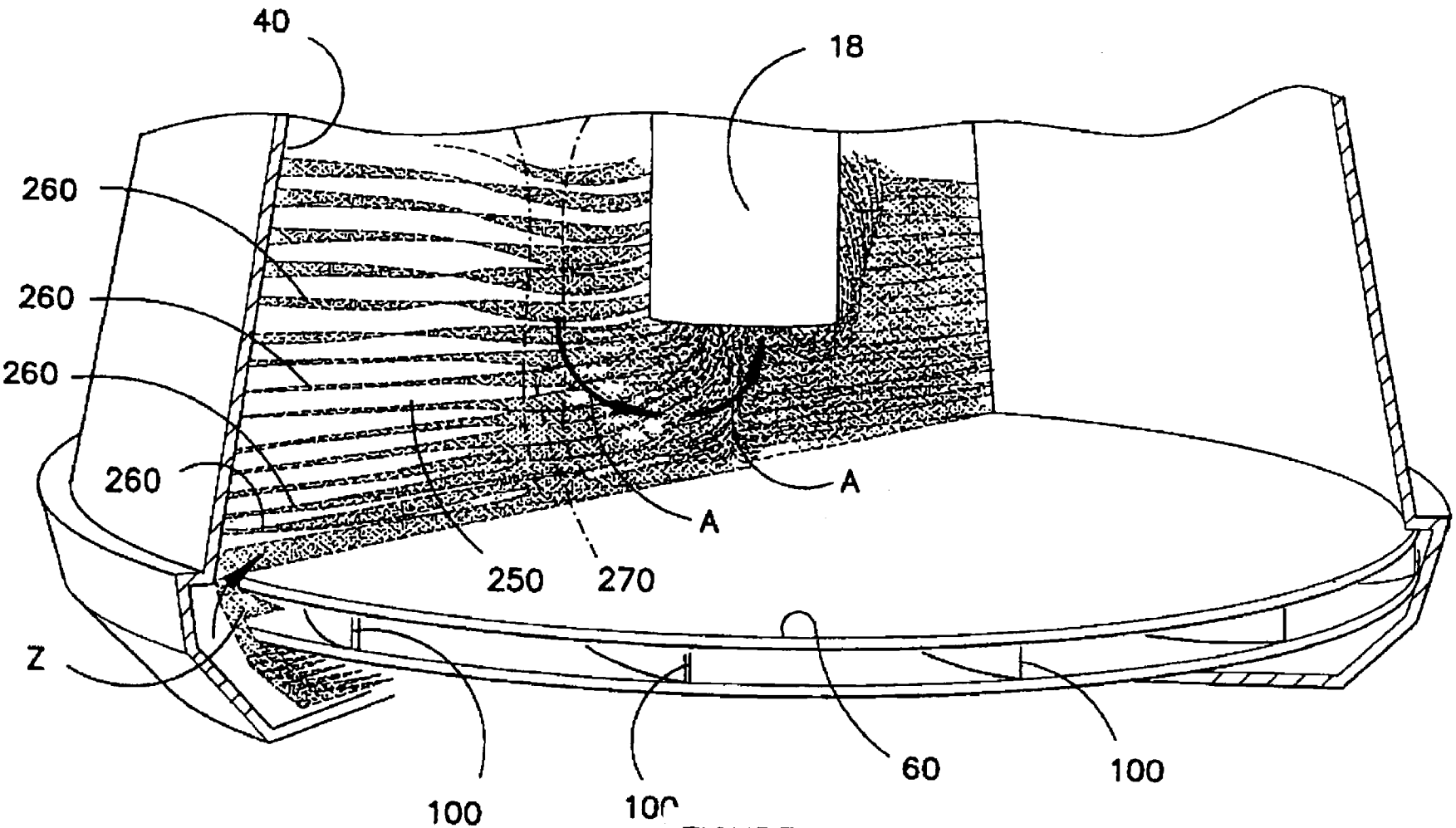
FIG. 17 is a side view partly cut away to show operation of the preferred embodiment of the invention.

As can be seen from FIG. 17, the particles move out of the region $R_1$ upwardly adjacent the wall 102 to the wall 103*a*. The step 103 is provided to maintain the particles within the region $R_1$ for a reasonable amount of time to ensure that they do not exit the region $R_1$ too quickly which could prevent the heavy gas in the region $R_1$ from being established and maintained. However, it should be understood that the cylinder 74 which is provided with the wall portion 102 and the step 103 need not necessarily be provided and the housing 12 could simply have a conical or vertical wall which may be provided by the wall 40 of the housing 12 adjacent the periphery of the disc 60.

As the number of heavy gas particles and small broken down particles build up in the region $R_1$, the particles generally move upwardly with the airflow created by the vanes 100 which, as previously described, direct the airflow upwardly relative to the disc 60. The movement of the airflow may also entrain some of the particles from the region $R_2$. The fine particles created in the region $R_1$ with perhaps a few of the larger particles from the region $R_2$ will move up the wall 103*a* and the wall 40 of the housing 12 in bands of rising air 260.

Those particles are entrained in a rotating, generally lamina flow of stream tubes 280 (which will be described in more detail with reference to FIG. 18), and exit through outlet tube 16 to be conveyed to the first cyclone 14. The particles which enter the exhaust outlet tube 18 are conveyed to the second cyclone 216 via the outlet tube 215 from the first cyclone 14 as previously described.

The particles which enter the complex vector field above the disc in the region 250 meet a generally standing wave 270 formed in the air above the disc 100. Large particles in those particles which meet the standing wave 270 tend to be moved back to the periphery of the disc 60 and back into the grinding zone Z for further grinding. The very light fines tend to do a loop as shown by arrow A in FIG. 17, and are extracted through exhaust tube 18 with the exhaust air from the housing 12.

The larger particle which meets the standing wave 270 and which are directed back down to the disc 60, moves back to the grinding zone Z as previously described, for more grinding until those particles are broken down into a particle size which will either travel up the wall 40 in the manner previously described, or which will be entrained in the airflow exiting the exhaust outlet 18.

Figure 18:
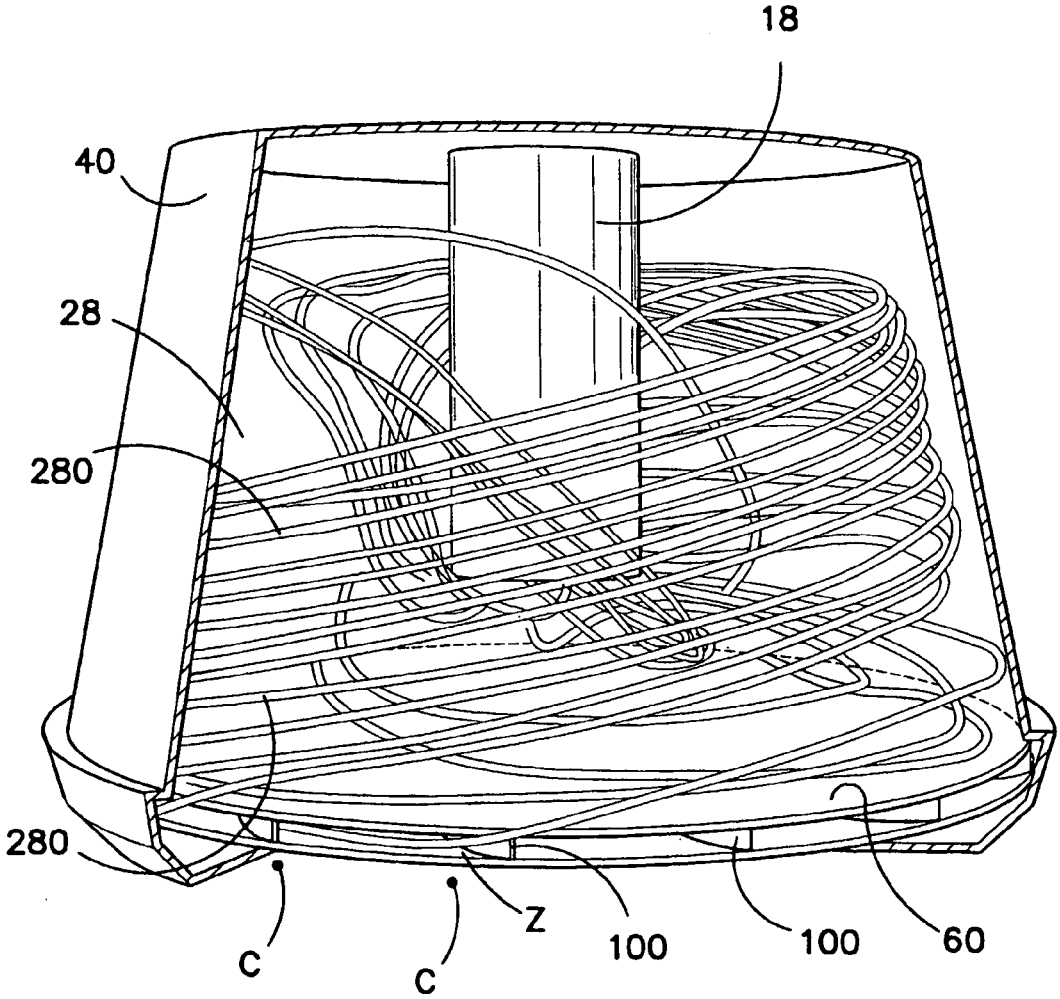
FIG. 18 is a schematic diagram showing air stream tubes which are created during operation of the preferred embodiments of the invention.

FIG. 18 shows the lamina airflow stream tubes 280 which are created and which move up in bands adjacent the wall 40. These stream tubes 280 carry the fine particles to the outlet 16. As can be seen in FIG. 18, the stream tubes remain in the grinding zone Z for only a very small time period and which may be only 15 to 30° of the rotation of the disc 60 (for example, from point C to point D in FIG. 17). These stream tubes are created by the vanes 100 which, as can be seen in FIGS. 3 and 9, are angled upwardly to tend to push the airflow into the grinding zone Z and then upwardly away from the disc.

Figure 19:
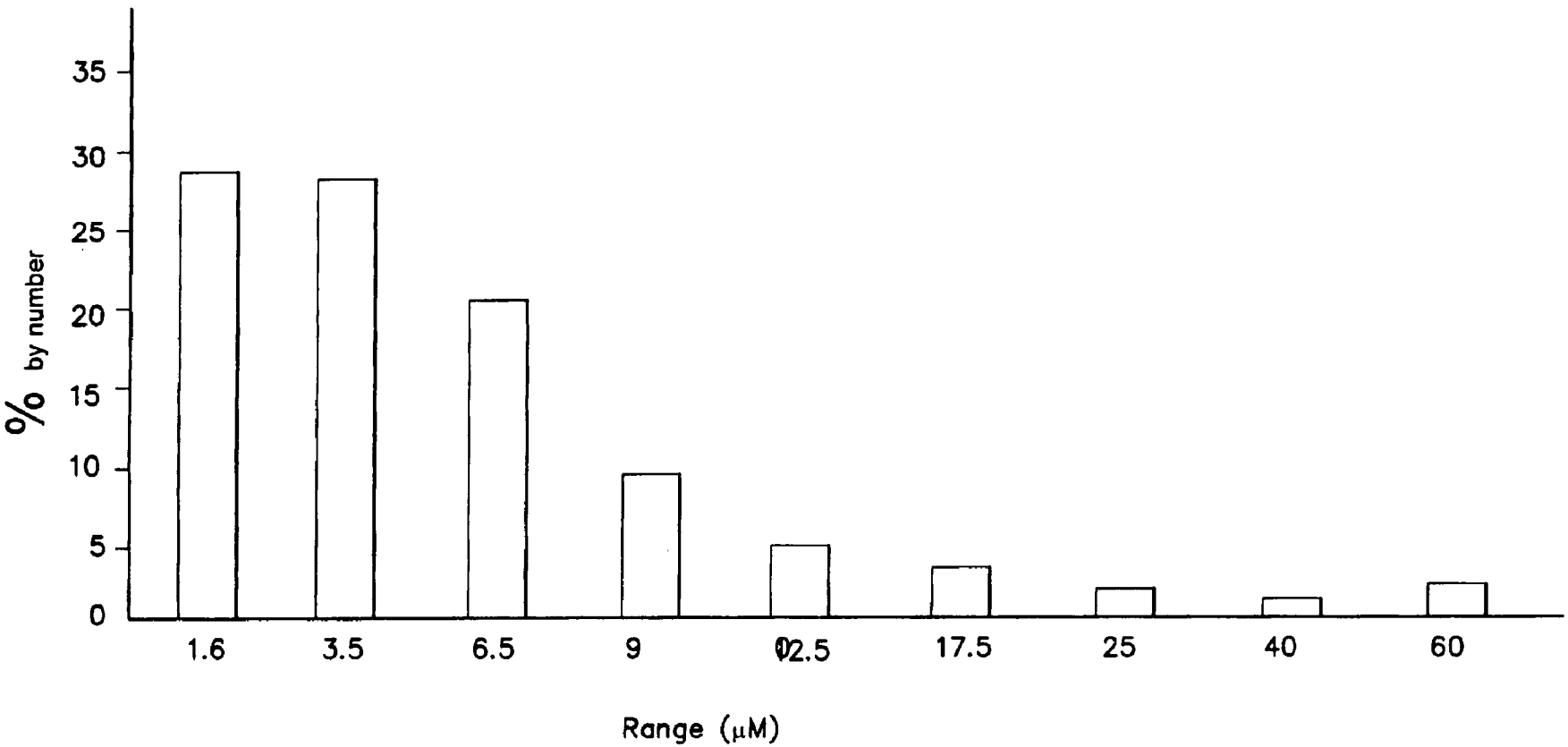
FIG. 19 is a graph showing experimental actual measured particle size distribution.
Figure 20:
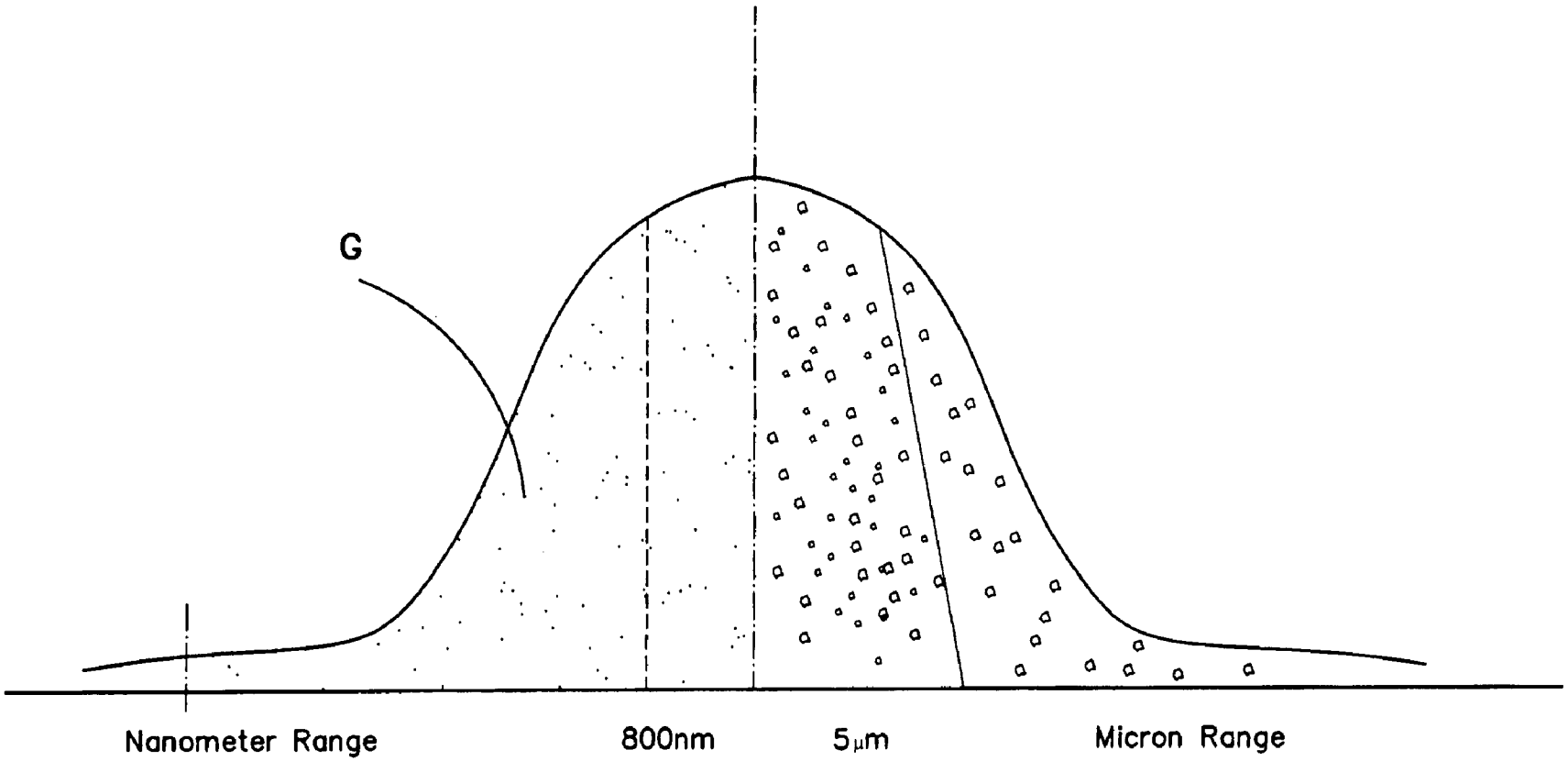
FIG. 20 is a graph showing full particle distribution.

FIG. 19 shows an actual measure distribution of small particles and other particles collected from the grinder. FIG. 20 extends this to the full distribution of small particles and particle sizes. Particles below a size of about 1.6 microns may not be collected because of their very small size and simply pass through all final filtering, and hence do not appear in the experimental actual measured distribution in FIG. 19. However, it is apparent that the distribution is generally in the form of a bell curve distribution, and when extended below the one micron size, as shown in FIG. 20, obviously much smaller particles than the smallest size actually measured are present. As can be seen from FIG. 20, the heavy gas in the region $R_1$ is made up from the heavy gas components shown in FIG. 20 and labelled G which are minute particles or fines having a size of less than about 800 nanometres. The heavy gas particles which travel up the wall 102 to the outlet 16 probably will not be collected because of their very small size and will simply pass through the filtering stations and exit with the exhaust air. However, these could be collected by electrostatic or magnetic devices or water entrapment.

In the preferred embodiments, the vanes 100 are directly upwardly as previously described. However, the vanes could be arranged substantially horizontally, and the angle of the wall 102 inclined more than that shown in the drawings so as to send the gas stream produced by the vanes 100 upwardly into the grinding zone Z.

If desired, pins or other like elements may extend upwardly from the base of the housing into the grinding zone Z at about the vicinity of the shear zone $S_2$ to create some turbulence at the shear zone which tends to assist the mixing of particles from the region $R_1$ at the shear zone with the heavy gas in the region $R_2$ to comminute the heavy particles into smaller particles at the shear $S_2$ in the region $R_1$.

The preferred embodiment of the apparatus may also be used in a vacuum. If the apparatus is used in a vacuum, the initial grinding process described with reference to FIG. 6 will still occur. However, to obtain the additional grinding in the grinding zone Z, it will be necessary to establish the heavy gas in the region $R_1$ by the introduction of particles which could form a functional heavy gas in the region $R_1$. This may be achieved by directing suitable fine particles through the inlet 108 and then through the vanes 100 to the periphery of the disc so that the particles establish the heavy gas and continue to act as the transport system in the manner described above. This embodiment would only be used in environments where it would not be desirable to have any other gas involved in the process. The heavy gas may be formed by an inert gas (for example, argon) and added particles of heavier material, or alternatively, if no gas at all is desired and a true vacuum required, the heavy gas could be formed by minute particles of a suitable material such as silicates or iron or the like.

If it is desired to grind very light particles such as feathers or wheat flour, and very fine particles required, it is necessary to establish the heavy gas other than from the material which is to be ground in the same manner as described above. In such embodiments, the heavy gas may be formed by adding water or some other particle such as the silicates or the like.

Figure 21:
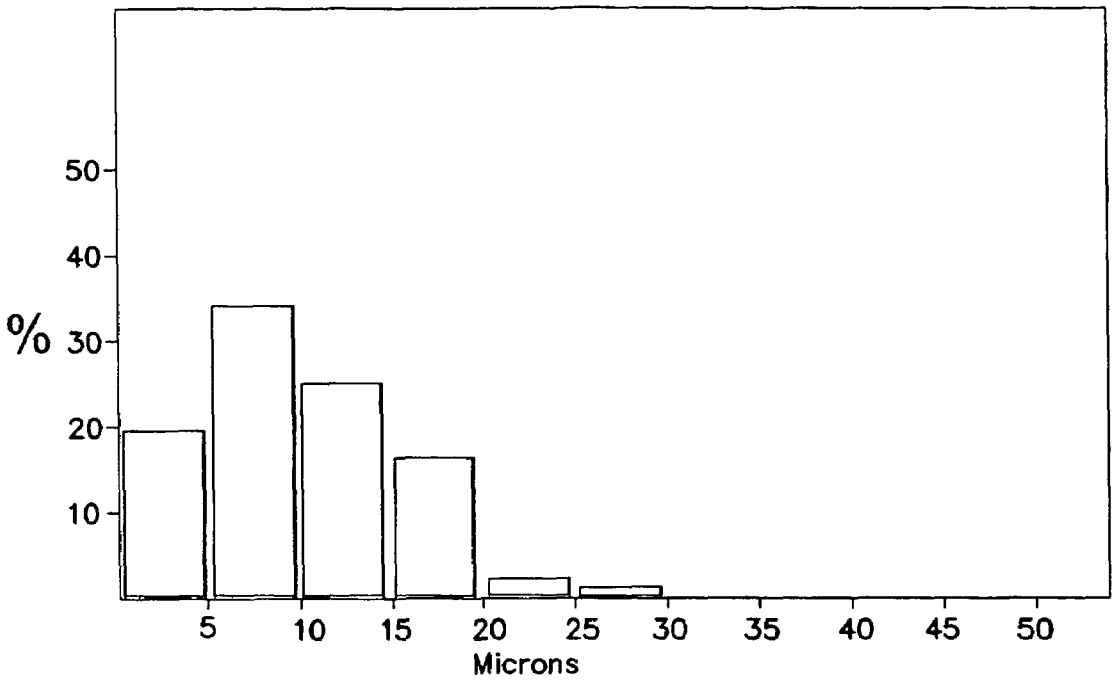
FIG. 21 is a graph showing particle sizes of small particles collected from a small particles outlet from the grinder of the preferred embodiment.
Figure 22:
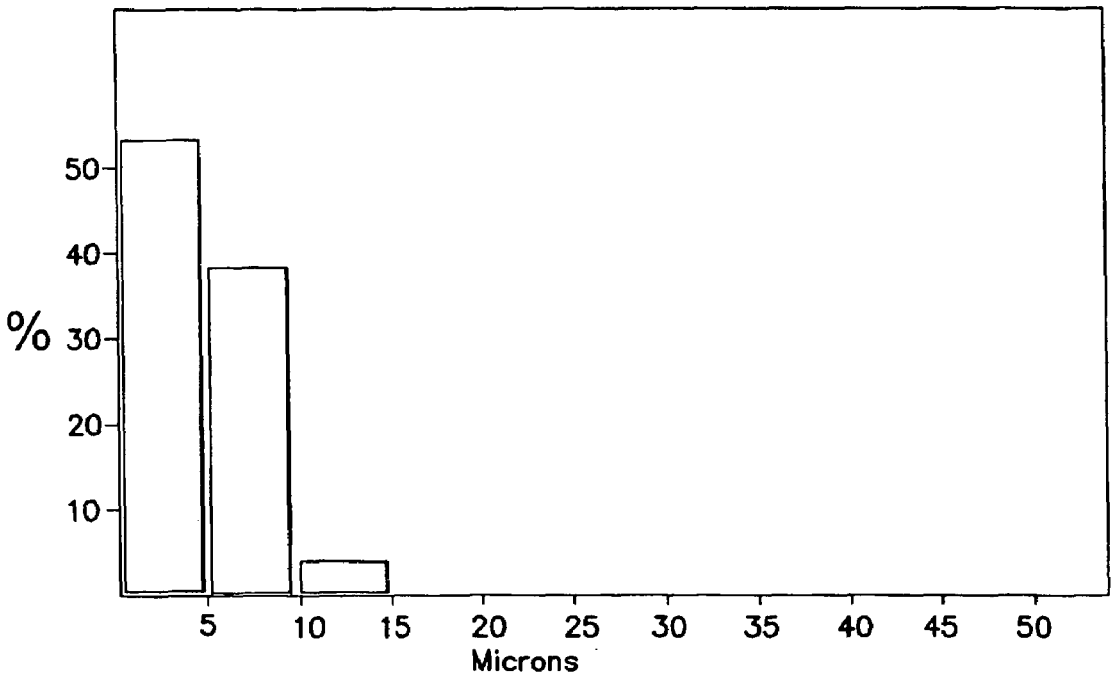
FIG. 22 is a graph showing particle sizes of small particles collected in a second separator in the preferred embodiment of the invention.

As is shown in FIG. 21, the particle size collected by the cyclone 14 and which appear at the outlet 217 are generally in the range of 0 to 30 microns (with those over 30 microns being ignored because they are rare), with the majority of the particles being in the range of 5 to 20 microns. As shown in FIG. 22, the particle size of the particles collected at the particles outlet 219 of the second cyclone are generally in the range of 0 to 10 microns, with a majority being less than 5 microns in size.

Since modifications within the spirit and scope of the invention may readily be effected by persons skilled within the art, it is to be understood that this invention is not limited to the particular embodiment described by way of example hereinabove.

The invention claimed is:

1. A grinder for producing small particles from material, comprising:

a housing having an inner wall;

a rotatable mechanical member in the housing having a periphery adjacent the inner wall;

a drive for driving the rotatable member for causing the rotatable member to create an annular flow of air between the periphery of the member and the inner wall, and for establishing a grinding zone between the periphery and the inner wall which comprises:

(a) a first region in which a heavy gas is established, the first region being between the inner wall and an intermediate position between the periphery of the member and the inner wall;

(b) a second region for receiving relatively large particles compared to the particles which make up the heavy gas, the second region being between the intermediate position and the periphery of the mechanical member; and (c) a shear zone between the first and second regions at the intermediate location; and wherein the relatively large particles received in the first region come into contact with the heavy gas particles across the shear zone where the relatively heavy particles are comminuted into smaller particles, some of which add to the heavy gas within the first region and the other of which form small particles of a size which do not behave as a heavy gas, and wherein the small particles, together with some of the particles which make up the heavy gas and other larger particles from the first region move out of the grinding zone with an annular flow of air from the grinding zone and travel to a first collection outlet for collection or fall back to the mechanical member and again travel to the first region for further grinding in the grinding zone; and wherein the rotatable member comprises a disc having vanes for creating the annular flow of air between the periphery of the disc and the inner wall, said vanes having an arcuate shape for directing air in the same direction as intended rotation of the disc for accelerating gas particles from an inner peripheral portion of the vanes to the periphery of the disc to create sufficient acceleration to enable the gas to exit the vanes in the direction of rotation of the disc without producing any substantial turbulence.

2. The grinder of claim 1 wherein the housing has an exhaust gas outlet for exhausting air from the housing in which some fines are entrained.

3. The grinder according to claim 2 wherein the exhaust outlet is connected to a second separator for separating small particles collected at the exhaust outlet from exhaust air exhausted through the exhaust outlet.

4. The grinder of claim having a separator connected to the first outlet for separating small particles and air collected from the first outlet.

5. A method of grinding material, comprising:

creating a grinding zone having a first annular region in which an annular flow of heavy gas is established and a second region spaced from the first region by a shear zone;

directing the material into the grinding zone so the material passes from the second region to the first region across the shear zone into the annular flow of heavy gas and is comminuted into smaller particles by contact between heavy gas particles in the heavy gas and the material; and collecting the comminuted particles.

6. The method according to claim 5 wherein the grinding zone comprises a second annular region arranged radially inwardly with respect to the first region in which the material can locate for movement into the heavy gas in the first region for comminution whilst in the heavy gas so that the comminution creates further heavy gas particles to maintain the annular flow of heavy gas within the first region, as well as the small particles which move out of the grinding region for collection.

7. The method according to claim 6 wherein some of the small particles which move out of the first region, together with some particles of material from the first region circulate within the housing and move back into the grinding zone for further grinding before those ground particles are collected from the housing.

8. The method according to claim 7 wherein the grinding zone is established by a rotatable disc arranged within the housing which has a periphery spaced from an inner wall of the housing and wherein the grinding zone is formed from the first region containing the heavy gas at a location between the wall of the housing and an intermediate location between the wall and the periphery of the disc, the second region is established between the intermediate position and the periphery of the disc, and the shear zone is established at the intermediate position between the first and second regions.

9. The method according to claim 8 wherein the grinding zone includes a third region between the inner wall of the disc and the first region, and a shear zone at the boundary between the first region and the third region.

10. The method according to claim 5 wherein the heavy gas is established by the initial supply of material to the housing and the breakdown of that material within the housing to minute particles which form the heavy gas in the first region.

11. The method according to claim 5 wherein the heavy gas is established by supply of minute particles separate to the material to be ground.

* * * * *